US011680208B2

(12) United States Patent
Quanci et al.

(10) Patent No.: US 11,680,208 B2
(45) **Date of Patent: *Jun. 20, 2023**

(54) SPRING-LOADED HEAT RECOVERY OVEN SYSTEM AND METHOD

(71) Applicant: SUNCOKE TECHNOLOGY AND DEVELOPMENT LLC, Lisle, IL (US)

(72) Inventors: John Francis Quanci, Haddonfield, NJ (US); Wes Alderman, Lisle, IL (US); Milos J. Kaplarevic, Naperville, IL (US); Suresh Mehta, Lisle, IL (US); F. Robert Carroll, Lisle, IL (US); Chun Wai Choi, Chicago, IL (US)

(73) Assignee: SUNCOKE TECHNOLOGY AND DEVELOPMENT LLC, Lisle, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/388,874

(22) Filed: Jul. 29, 2021

(65) Prior Publication Data

US 2022/0195303 A1 Jun. 23, 2022

Related U.S. Application Data

(63) Continuation of application No. 16/729,219, filed on Dec. 27, 2019, now Pat. No. 11,098,252.
(Continued)

(51) Int. Cl.
*C10B 29/04* (2006.01)
*F24C 15/08* (2006.01)
(Continued)

(52) U.S. Cl.
CPC ..... *C10B 29/04* (2013.01); *C10B 13/00* (2013.01); *C10B 25/12* (2013.01); *C10B 25/18* (2013.01); *C10B 29/08* (2013.01); *F24C 15/08* (2013.01)

(58) Field of Classification Search
CPC ..... C10B 13/00; C10B 25/12; C10B 29/04; C10B 29/08
See application file for complete search history.

(56) References Cited

U.S. PATENT DOCUMENTS 425,797 A 4/1890 Hunt
469,868 A 3/1892 Osbourn
(Continued)

FOREIGN PATENT DOCUMENTS

CA 1172895 8/1984
CA 2775992 5/2011
(Continued)

OTHER PUBLICATIONS

U.S. Appl. No. 17/321,857, filed May 17, 2021, Quanci et al.
(Continued)

*Primary Examiner* — Renee Robinson
(74) *Attorney, Agent, or Firm* — Perkins Coie LLP

(57) ABSTRACT

A coke oven can include an oven body, a foundation, and a plurality of beams separating the oven body from the foundation, A buckstay applies force to the oven body to maintain compression on the oven body during thermal cycling of the coke oven. The coke oven further comprises a spring-loaded compression device, which can include a restraining device, an anchor coupled to the restraining device, and a spring coupled to the restraining device. The anchor can be attached to one or more of the beams, the foundation of the oven, or to a similar compression device on an opposite side of the oven. The spring applies force between the restraining device and the one or more beams or foundation to compress the buckstay against the oven. The force applied by the spring can maintain structural stability of the coke oven over a plurality of thermal cycles.

13 Claims, 12 Drawing Sheets

Related U.S. Application Data

(60) Provisional application No. 62/786,325, filed on Dec. 28, 2018.

(51) Int. Cl.

| | |
|---|---|
| ***C10B 13/00*** | (2006.01) |
| ***C10B 25/12*** | (2006.01) |
| ***C10B 25/18*** | (2006.01) |
| ***C10B 29/08*** | (2006.01) |

(56) References Cited

U.S. PATENT DOCUMENTS 760,372 A 5/1904 Beam
845,719 A 2/1907 Schniewind
875,989 A 1/1908 Garner
976,580 A 7/1909 Krause
1,140,798 A 5/1915 Carpenter
1,424,777 A 8/1922 Schondeling
1,429,346 A 9/1922 Horn
1,430,027 A 9/1922 Plantinga
1,486,401 A 3/1924 Van Ackeren
1,530,995 A 3/1925 Geiger
1,572,391 A 2/1926 Klaiber
1,677,973 A 7/1928 Marquard
1,705,039 A 3/1929 Thornhill
1,721,813 A 7/1929 Geipert
1,757,682 A 5/1930 Palm
1,818,370 A 8/1931 Wine
1,818,994 A 8/1931 Kreisinger
1,830,951 A 11/1931 Lovett
1,848,818 A 3/1932 Becker
1,895,202 A 1/1933 Montgomery
1,947,499 A 2/1934 Schrader et al.
1,955,962 A 4/1934 Jones
1,979,507 A 11/1934 Underwood
2,075,337 A 3/1937 Burnaugh
2,141,035 A 12/1938 Daniels
2,195,466 A 4/1940 Otto
2,235,970 A 3/1941 Wilputte
2,340,283 A 1/1944 Vladu
2,340,981 A 2/1944 Otto
2,394,173 A 2/1946 Harris et al.
2,424,012 A 7/1947 Bangham et al.
2,486,199 A 10/1949 Nier
2,609,948 A 9/1952 Laveley
2,641,575 A 6/1953 Otto
2,649,978 A 8/1953 Smith
2,667,185 A 1/1954 Beavers
2,723,725 A 11/1955 Keiffer
2,756,842 A 7/1956 Chamberlin et al.
2,813,708 A 11/1957 Frey
2,827,424 A 3/1958 Homan
2,873,816 A 2/1959 Emil et al.
2,902,991 A 9/1959 Whitman
2,907,698 A 10/1959 Schulz
2,968,083 A 1/1961 Lentz et al.
3,015,893 A 1/1962 McCreary
3,026,715 A 3/1962 Briggs
3,033,764 A 5/1962 Hannes
3,175,961 A 3/1965 Samson
3,199,135 A 8/1965 Trucker
3,224,805 A 12/1965 Clyatt
3,259,551 A 7/1966 Thompson
3,265,044 A 8/1966 Juchtern
3,267,913 A 8/1966 Jakob
3,327,521 A 6/1967 Briggs
3,342,990 A 9/1967 Barrington et al.
3,444,046 A 5/1969 Harlow
3,444,047 A 5/1969 Wilde
3,448,012 A 6/1969 Allred
3,453,839 A 7/1969 Sabin
3,462,345 A 8/1969 Kernan
3,511,030 A 5/1970 Brown et al.
3,542,650 A 11/1970 Kulakov
3,545,470 A 12/1970 Paton
3,587,198 A 6/1971 Hensel
3,591,827 A 7/1971 Hall
3,592,742 A 7/1971 Thompson
3,616,408 A 10/1971 Hickam
3,623,511 A 11/1971 Levin
3,630,852 A 12/1971 Nashan et al.
3,652,403 A 3/1972 Knappstein et al.
3,676,305 A 7/1972 Cremer
3,709,794 A 1/1973 Kinzler et al.
3,710,551 A 1/1973 Sved
3,746,626 A 7/1973 Morrison, Jr.
3,748,235 A 7/1973 Pries
3,784,034 A 1/1974 Thompson
3,806,032 A 4/1974 Pries
3,811,572 A 5/1974 Tatterson
3,836,161 A 10/1974 Pries
3,839,156 A 10/1974 Jakobi et al.
3,844,900 A 10/1974 Schulte
3,857,758 A 12/1974 Mole
3,875,016 A 4/1975 Schmidt-Balve
3,876,143 A 4/1975 Rossow et al.
3,876,506 A 4/1975 Dix et al.
3,878,053 A 4/1975 Hyde
3,894,302 A 7/1975 Lasater
3,897,312 A 7/1975 Armour et al.
3,906,992 A 9/1975 Leach
3,912,091 A 10/1975 Thompson
3,912,597 A 10/1975 MacDonald
3,917,458 A 11/1975 Polak
3,928,144 A 12/1975 Jakimowicz
3,930,961 A 1/1976 Sustarsic et al.
3,933,443 A 1/1976 Lohrmann
3,957,591 A 5/1976 Riecker
3,959,084 A 5/1976 Price
3,963,582 A 6/1976 Helm et al.
3,969,191 A 7/1976 Bollenbach
3,975,148 A 8/1976 Fukuda et al.
3,979,870 A 9/1976 Moore
3,984,289 A 10/1976 Sustarsic et al.
3,990,948 A 11/1976 Lindgren
4,004,702 A 1/1977 Szendroi
4,004,983 A 1/1977 Pries
4,025,395 A 5/1977 Ekholm et al.
4,040,910 A 8/1977 Knappstein et al.
4,045,056 A 8/1977 Kandakov et al.
4,045,299 A 8/1977 McDonald
4,059,885 A 11/1977 Oldengott
4,065,059 A 12/1977 Jablin
4,067,462 A 1/1978 Thompson
4,077,848 A 3/1978 Grainer et al.
4,083,753 A 4/1978 Rogers et al.
4,086,231 A 4/1978 Ikio
4,093,245 A 6/1978 Connor
4,100,033 A 7/1978 Holter
4,100,491 A 7/1978 Newman, Jr. et al.
4,100,889 A 7/1978 Chayes
4,111,757 A 9/1978 Carimboli
4,124,450 A 11/1978 MacDonald
4,133,720 A 1/1979 Franzer et al.
4,135,948 A 1/1979 Mertens et al.
4,141,796 A 2/1979 Clark et al.
4,143,104 A 3/1979 van Konijnenburg et al.
4,145,195 A 3/1979 Knappstein et al.
4,147,230 A 4/1979 Ormond et al.
4,162,546 A 7/1979 Shortell et al.
4,176,013 A 11/1979 Garthus et al.
4,181,459 A 1/1980 Price
4,189,272 A 2/1980 Gregor et al.
4,194,951 A 3/1980 Pries
4,196,053 A 4/1980 Grohmann
4,211,608 A 7/1980 Kwasnoski et al.
4,211,611 A 7/1980 Bocsanczy
4,213,489 A 7/1980 Cain
4,213,828 A 7/1980 Calderon
4,222,748 A 9/1980 Argo et al.
4,222,824 A 9/1980 Flockenhaus et al.
4,224,109 A 9/1980 Flockenhaus et al.
4,225,393 A 9/1980 Gregor et al.

(56) References Cited

U.S. PATENT DOCUMENTS 4,226,113 A 10/1980 Pelletier et al.
4,230,498 A 10/1980 Ruecki
4,235,830 A 11/1980 Bennett et al.
4,239,602 A 12/1980 La Bate
4,248,671 A 2/1981 Belding
4,249,997 A 2/1981 Schmitz
4,263,099 A 4/1981 Porter
4,268,360 A 5/1981 Tsuzuki et al.
4,271,814 A 6/1981 Lister
4,284,478 A 8/1981 Brommel
4,285,772 A 8/1981 Kress
4,287,024 A 9/1981 Thompson
4,289,479 A 9/1981 Johnson
4,289,584 A 9/1981 Chuss et al.
4,289,585 A 9/1981 Wagener et al.
4,296,938 A 10/1981 Offermann et al.
4,299,666 A 11/1981 Ostmann
4,302,935 A 12/1981 Cousimano
4,303,615 A 12/1981 Jarmell et al.
4,307,673 A 12/1981 Caughey
4,314,787 A 2/1982 Kwasnik et al.
4,316,435 A 2/1982 Nagamatsu et al.
4,324,568 A 4/1982 Wilcox et al.
4,330,372 A 5/1982 Cairns et al.
4,334,963 A 6/1982 Stog
4,336,107 A 6/1982 Irwin
4,336,843 A 6/1982 Petty
4,340,445 A 7/1982 Kucher et al.
4,342,195 A 8/1982 Lo
4,344,820 A 8/1982 Thompson
4,344,822 A 8/1982 Schwartz et al.
4,353,189 A 10/1982 Thiersch et al.
4,366,029 A 12/1982 Bixby et al.
4,373,244 A 2/1983 Mertens et al.
4,375,388 A 3/1983 Hara et al.
4,385,962 A 5/1983 Stewen et al.
4,391,674 A 7/1983 Velmin et al.
4,392,824 A 7/1983 Struck et al.
4,394,217 A 7/1983 Holz et al.
4,395,269 A 7/1983 Schuler
4,396,394 A 8/1983 Li et al.
4,396,461 A 8/1983 Neubaum et al.
4,406,619 A 9/1983 Oldengott
4,407,237 A 10/1983 Merritt
4,421,070 A 12/1983 Sullivan
4,431,484 A 2/1984 Weber et al.
4,439,277 A 3/1984 Dix
4,440,098 A 4/1984 Adams
4,445,977 A 5/1984 Husher
4,446,018 A 5/1984 Cerwick
4,448,541 A 5/1984 Lucas
4,452,749 A 6/1984 Kolvek et al.
4,459,103 A 7/1984 Gieskieng
4,469,446 A 9/1984 Goodboy
4,474,344 A 10/1984 Bennett
4,487,137 A 12/1984 Horvat et al.
4,498,786 A 2/1985 Ruscheweyh
4,506,025 A 3/1985 Kleeb et al.
4,508,539 A 4/1985 Nakai
4,518,461 A 5/1985 Gelfand
4,527,488 A 7/1985 Lindgren
4,564,420 A 1/1986 Spindeler et al.
4,568,426 A 2/1986 Orlando
4,570,670 A 2/1986 Johnson
4,614,567 A 9/1986 Stahlherm et al.
4,643,327 A 2/1987 Campbell
4,645,513 A 2/1987 Kubota et al.
4,655,193 A 4/1987 Blacket
4,655,804 A 4/1987 Kercheval et al.
4,666,675 A 5/1987 Parker et al.
4,680,167 A 7/1987 Orlando
4,690,689 A 9/1987 Malcosky et al.
4,704,195 A 11/1987 Janicka et al.
4,720,262 A 1/1988 Durr et al.
4,724,976 A 2/1988 Lee
4,726,465 A 2/1988 Kwasnik et al.
4,732,652 A 3/1988 Durselen et al.
4,749,446 A 6/1988 van Laar et al.
4,793,981 A 12/1988 Doyle et al.
4,824,614 A 4/1989 Jones et al.
4,889,698 A 12/1989 Moller et al.
4,898,021 A 2/1990 Weaver et al.
4,918,975 A 4/1990 Voss
4,919,170 A 4/1990 Kallinich et al.
4,921,483 A 5/1990 Wijay
4,929,179 A 5/1990 Breidenbach et al.
4,941,824 A 7/1990 Holter et al.
5,052,922 A 10/1991 Stokman et al.
5,062,925 A 11/1991 Durselen et al.
5,078,822 A 1/1992 Hodges et al.
5,087,328 A 2/1992 Wegerer et al.
5,114,542 A 5/1992 Childress et al.
5,213,138 A 5/1993 Presz
5,227,106 A 7/1993 Kolvek
5,228,955 A 7/1993 Westbrook, III
5,234,601 A 8/1993 Janke et al.
5,318,671 A 6/1994 Pruitt
5,370,218 A 12/1994 Johnson et al.
5,398,543 A 3/1995 Fukushima et al.
5,423,152 A 6/1995 Kolvek
5,447,606 A 9/1995 Pruitt
5,480,594 A 1/1996 Wilkerson et al.
5,542,650 A 8/1996 Abel et al.
5,597,452 A 1/1997 Hippe et al.
5,603,810 A 2/1997 Michler
5,622,280 A 4/1997 Mays et al.
5,659,110 A 8/1997 Herden et al.
5,670,025 A 9/1997 Baird
5,687,768 A 11/1997 Albrecht et al.
5,705,037 A 1/1998 Reinke et al.
5,715,962 A 2/1998 McDonnell
5,720,855 A 2/1998 Baird
5,752,548 A 5/1998 Matsumoto et al.
5,787,821 A 8/1998 Bhat et al.
5,810,032 A 9/1998 Hong et al.
5,816,210 A 10/1998 Yamaguchi
5,857,308 A 1/1999 Dismore et al.
5,881,551 A 3/1999 Dang
5,913,448 A 6/1999 Mann et al.
5,928,476 A 7/1999 Daniels
5,966,886 A 10/1999 Di Loreto
5,968,320 A 10/1999 Sprague
6,002,993 A 12/1999 Naito et al.
6,003,706 A 12/1999 Rosen
6,017,214 A 1/2000 Sturgulewski
6,059,932 A 5/2000 Sturgulewski
6,139,692 A 10/2000 Tamura et al.
6,152,668 A 11/2000 Knoch
6,156,688 A 12/2000 Ando et al.
6,173,679 B1 1/2001 Bruckner et al.
6,187,148 B1 2/2001 Sturgulewski
6,189,819 B1 2/2001 Racine
6,290,494 B1 9/2001 Barkdoll
6,412,221 B1 7/2002 Emsbo
6,495,268 B1 12/2002 Harth, III et al.
6,539,602 B1 4/2003 Ozawa et al.
6,596,128 B2 7/2003 Westbrook
6,626,984 B1 9/2003 Taylor
6,699,035 B2 3/2004 Brooker
6,712,576 B2 3/2004 Skarzenski et al.
6,758,875 B2 7/2004 Reid et al.
6,786,941 B2 9/2004 Reeves et al.
6,830,660 B1 12/2004 Yamauchi et al.
6,907,895 B2 6/2005 Johnson et al.
6,946,011 B2 9/2005 Snyder
6,964,236 B2 11/2005 Schucker
7,056,390 B2 6/2006 Fratello
7,077,892 B2 7/2006 Lee
7,314,060 B2 1/2008 Chen et al.
7,331,298 B2 2/2008 Barkdoll et al.
7,433,743 B2 10/2008 Pistikopoulos et al.
7,497,930 B2 3/2009 Barkdoll et al.
7,547,377 B2 6/2009 Inamasu et al.
7,611,609 B1 11/2009 Valia et al.

(56) References Cited

U.S. PATENT DOCUMENTS

| | | | |
|---|---|---|---|
| 7,644,711 | B2 | 1/2010 | Creel |
| 7,722,843 | B1 | 5/2010 | Srinivasachar |
| 7,727,307 | B2 | 6/2010 | Winkler |
| 7,785,447 | B2 | 8/2010 | Eatough et al. |
| 7,803,627 | B2 | 9/2010 | Hodges et al. |
| 7,823,401 | B2 | 11/2010 | Takeuchi et al. |
| 7,827,689 | B2 | 11/2010 | Crane |
| 7,998,316 | B2 | 8/2011 | Barkdoll |
| 8,071,060 | B2 | 12/2011 | Ukai et al. |
| 8,079,751 | B2 | 12/2011 | Kapila et al. |
| 8,080,088 | B1 | 12/2011 | Srinivasachar |
| 8,146,376 | B1 | 4/2012 | Williams et al. |
| 8,152,970 | B2 | 4/2012 | Barkdoll et al. |
| 8,172,930 | B2 | 5/2012 | Barkdoll |
| 8,236,142 | B2 | 8/2012 | Westbrook |
| 8,266,853 | B2 | 9/2012 | Bloom et al. |
| 8,383,055 | B2 | 2/2013 | Palmer |
| 8,398,935 | B2 | 3/2013 | Howell et al. |
| 8,409,405 | B2 | 4/2013 | Kim et al. |
| 8,500,881 | B2 | 8/2013 | Orita et al. |
| 8,515,508 | B2 | 8/2013 | Kawamura et al. |
| 8,568,568 | B2 | 10/2013 | Schuecker et al. |
| 8,640,635 | B2 | 2/2014 | Bloom et al. |
| 8,647,476 | B2 | 2/2014 | Kim et al. |
| 8,800,795 | B2 | 8/2014 | Hwang |
| 8,956,995 | B2 | 2/2015 | Masatsugu et al. |
| 8,980,063 | B2 | 3/2015 | Kim et al. |
| 9,039,869 | B2 | 5/2015 | Kim et al. |
| 9,057,023 | B2 | 6/2015 | Reichelt et al. |
| 9,103,234 | B2 | 8/2015 | Gu et al. |
| 9,169,439 | B2 | 10/2015 | Sarpen et al. |
| 9,193,913 | B2 | 11/2015 | Quanci et al. |
| 9,193,915 | B2 | 11/2015 | West et al. |
| 9,200,225 | B2 | 12/2015 | Barkdoll et al. |
| 9,238,778 | B2 | 1/2016 | Quanci et al. |
| 9,243,186 | B2 | 1/2016 | Quanci et al. |
| 9,249,357 | B2 | 2/2016 | Quanci et al. |
| 9,273,249 | B2 | 3/2016 | Quanci et al. |
| 9,273,250 | B2 | 3/2016 | Choi et al. |
| 9,321,965 | B2 | 4/2016 | Barkdoll |
| 9,359,554 | B2 | 6/2016 | Quanci et al. |
| 9,404,043 | B2 | 8/2016 | Kim |
| 9,463,980 | B2 | 10/2016 | Fukada et al. |
| 9,498,786 | B2 | 11/2016 | Pearson |
| 9,580,656 | B2 | 2/2017 | Quanci et al. |
| 9,672,499 | B2 | 6/2017 | Quanci et al. |
| 9,708,542 | B2 | 7/2017 | Quanci et al. |
| 9,862,888 | B2 | 1/2018 | Quanci et al. |
| 9,976,089 | B2 | 5/2018 | Quanci et al. |
| 10,016,714 | B2 | 7/2018 | Quanci et al. |
| 10,041,002 | B2 | 8/2018 | Quanci et al. |
| 10,047,295 | B2 | 8/2018 | Chun et al. |
| 10,047,296 | B2 | 8/2018 | Chun et al. |
| 10,053,627 | B2 | 8/2018 | Sarpen et al. |
| 10,233,392 | B2 | 3/2019 | Quanci et al. |
| 10,308,876 | B2 | 6/2019 | Quanci et al. |
| 10,323,192 | B2 | 6/2019 | Quanci et al. |
| 10,392,563 | B2 | 8/2019 | Kim et al. |
| 10,435,042 | B1 | 10/2019 | Weymouth |
| 10,526,541 | B2 | 1/2020 | West et al. |
| 10,578,521 | B1 | 3/2020 | Dinakaran et al. |
| 10,611,965 | B2 | 4/2020 | Quanci et al. |
| 10,619,101 | B2 | 4/2020 | Quanci et al. |
| 10,732,621 | B2 | 8/2020 | Celia et al. |
| 10,877,007 | B2 | 12/2020 | Steele et al. |
| 10,883,051 | B2 | 1/2021 | Quanci et al. |
| 10,920,148 | B2 | 2/2021 | Quanci et al. |
| 10,927,303 | B2 | 2/2021 | Choi et al. |
| 10,947,455 | B2 | 3/2021 | Quanci et al. |
| 10,968,393 | B2 | 4/2021 | West et al. |
| 10,968,395 | B2 | 4/2021 | Quanci et al. |
| 10,975,309 | B2 | 4/2021 | Quanci et al. |
| 10,975,310 | B2 | 4/2021 | Quanci et al. |
| 10,975,311 | B2 | 4/2021 | Quanci et al. |
| 1,378,782 | A1 | 5/2021 | Floyd |
| 11,008,517 | B2 | 5/2021 | Chun et al. |
| 11,008,518 | B2 | 5/2021 | Quanci et al. |
| 11,021,655 | B2 | 6/2021 | Quanci et al. |
| 11,053,444 | B2 | 7/2021 | Quanci et al. |
| 11,098,252 | B2 | 8/2021 | Quanci et al. |
| 11,117,087 | B2 | 9/2021 | Quanci |
| 11,142,699 | B2 | 10/2021 | West et al. |
| 11,186,778 | B2 | 11/2021 | Crum et al. |
| 11,193,069 | B2 | 12/2021 | Quanci et al. |
| 11,214,739 | B2 | 1/2022 | Quanci et al. |
| 2002/0170605 | A1 | 11/2002 | Shiraishi et al. |
| 2003/0014954 | A1 | 1/2003 | Ronning et al. |
| 2003/0015809 | A1 | 1/2003 | Carson |
| 2003/0057083 | A1 | 3/2003 | Eatough et al. |
| 2004/0220840 | A1 | 11/2004 | Bonissone et al. |
| 2005/0087767 | A1 | 4/2005 | Fitzgerald et al. |
| 2005/0096759 | A1 | 5/2005 | Benjamin et al. |
| 2006/0029532 | A1 | 2/2006 | Breen et al. |
| 2006/0102420 | A1 | 5/2006 | Huber et al. |
| 2006/0149407 | A1 | 7/2006 | Markham et al. |
| 2007/0087946 | A1 | 4/2007 | Quest et al. |
| 2007/0102278 | A1 | 5/2007 | Inamasu et al. |
| 2007/0116619 | A1 | 5/2007 | Taylor et al. |
| 2007/0251198 | A1 | 11/2007 | Witter |
| 2008/0028935 | A1 | 2/2008 | Andersson |
| 2008/0179165 | A1 | 7/2008 | Chen et al. |
| 2008/0250863 | A1 | 10/2008 | Moore |
| 2008/0257236 | A1 | 10/2008 | Green |
| 2008/0271985 | A1 | 11/2008 | Yamasaki |
| 2008/0289305 | A1 | 11/2008 | Girondi |
| 2009/0007785 | A1 | 1/2009 | Kimura et al. |
| 2009/0032385 | A1 | 2/2009 | Engle |
| 2009/0105852 | A1 | 4/2009 | Wintrich et al. |
| 2009/0152092 | A1 | 6/2009 | Kim et al. |
| 2009/0162269 | A1 | 6/2009 | Barger et al. |
| 2009/0217576 | A1 | 9/2009 | Kim et al. |
| 2009/0257932 | A1 | 10/2009 | Canari et al. |
| 2009/0283395 | A1 | 11/2009 | Hippe |
| 2010/0015564 | A1 | 1/2010 | Chun et al. |
| 2010/0095521 | A1 | 4/2010 | Kartal et al. |
| 2010/0106310 | A1 | 4/2010 | Grohman |
| 2010/0113266 | A1 | 5/2010 | Abe et al. |
| 2010/0115912 | A1 | 5/2010 | Worley |
| 2010/0119425 | A1 | 5/2010 | Palmer |
| 2010/0181297 | A1 | 7/2010 | Whysail |
| 2010/0196597 | A1 | 8/2010 | Di Loreto |
| 2010/0276269 | A1 | 11/2010 | Schuecker et al. |
| 2010/0287871 | A1 | 11/2010 | Bloom et al. |
| 2010/0300867 | A1 | 12/2010 | Kim et al. |
| 2010/0314234 | A1 | 12/2010 | Knoch et al. |
| 2011/0000284 | A1 | 1/2011 | Kumar et al. |
| 2011/0014406 | A1 | 1/2011 | Coleman et al. |
| 2011/0048917 | A1 | 3/2011 | Kim et al. |
| 2011/0083314 | A1 | 4/2011 | Baird |
| 2011/0088600 | A1 | 4/2011 | McRae |
| 2011/0120852 | A1 | 5/2011 | Kim |
| 2011/0144406 | A1 | 6/2011 | Masatsugu et al. |
| 2011/0168482 | A1 | 7/2011 | Merchant et al. |
| 2011/0174301 | A1 | 7/2011 | Haydock et al. |
| 2011/0192395 | A1 | 8/2011 | Kim |
| 2011/0198206 | A1 | 8/2011 | Kim et al. |
| 2011/0223088 | A1 | 9/2011 | Chang et al. |
| 2011/0253521 | A1 | 10/2011 | Kim |
| 2011/0291827 | A1 | 12/2011 | Baldocchi et al. |
| 2011/0313218 | A1 | 12/2011 | Dana |
| 2011/0315538 | A1 | 12/2011 | Kim et al. |
| 2012/0031076 | A1 | 2/2012 | Frank et al. |
| 2012/0125709 | A1 | 5/2012 | Merchant et al. |
| 2012/0152720 | A1 | 6/2012 | Reichelt et al. |
| 2012/0177541 | A1 | 7/2012 | Mutsuda et al. |
| 2012/0179421 | A1 | 7/2012 | Dasgupta |
| 2012/0180133 | A1 | 7/2012 | Ai-Harbi et al. |
| 2012/0228115 | A1 | 9/2012 | Westbrook |
| 2012/0247939 | A1 | 10/2012 | Kim et al. |
| 2012/0305380 | A1 | 12/2012 | Wang et al. |
| 2012/0312019 | A1 | 12/2012 | Rechtman |
| 2013/0020781 | A1 | 1/2013 | Kishikawa |
| 2013/0045149 | A1 | 2/2013 | Miller |
| 2013/0213114 | A1 | 8/2013 | Wetzig et al. |

(56) References Cited

U.S. PATENT DOCUMENTS

| | | | |
|---|---|---|---|
| 2013/0216717 | A1 | 8/2013 | Rago et al. |
| 2013/0220373 | A1 | 8/2013 | Kim |
| 2013/0306462 | A1 | 11/2013 | Kim et al. |
| 2014/0033917 | A1 | 2/2014 | Rodgers et al. |
| 2014/0039833 | A1 | 2/2014 | Sharpe, Jr. et al. |
| 2014/0156584 | A1 | 6/2014 | Motukuri et al. |
| 2014/0182683 | A1 | 7/2014 | Quanci et al. |
| 2014/0208997 | A1 | 7/2014 | Alferyev et al. |
| 2014/0224123 | A1 | 8/2014 | Walters |
| 2014/0262726 | A1 | 9/2014 | West et al. |
| 2015/0041304 | A1 | 2/2015 | Kiim et al. |
| 2015/0122629 | A1 | 5/2015 | Freimuth et al. |
| 2015/0143908 | A1 | 5/2015 | Cetinkaya |
| 2015/0175433 | A1 | 6/2015 | Micka et al. |
| 2015/0219530 | A1 | 8/2015 | Li et al. |
| 2015/0226499 | A1 | 8/2015 | Mikkelsen |
| 2015/0361347 | A1 | 12/2015 | Ball et al. |
| 2016/0026193 | A1 | 1/2016 | Rhodes et al. |
| 2016/0048139 | A1 | 2/2016 | Samples et al. |
| 2016/0149944 | A1 | 5/2016 | Obermeirer et al. |
| 2016/0154171 | A1 | 6/2016 | Kato et al. |
| 2016/0319198 | A1 | 11/2016 | Quanci et al. |
| 2016/0370082 | A1 | 12/2016 | Olivo |
| 2017/0173519 | A1 | 6/2017 | Naito |
| 2017/0182447 | A1 | 6/2017 | Sappok et al. |
| 2017/0183569 | A1 | 6/2017 | Quanci et al. |
| 2017/0226425 | A1 | 8/2017 | Kim et al. |
| 2017/0261417 | A1 | 9/2017 | Zhang |
| 2017/0313943 | A1 | 11/2017 | Valdevies |
| 2017/0352243 | A1 | 12/2017 | Quanci et al. |
| 2018/0340122 | A1 | 11/2018 | Crum et al. |
| 2019/0169503 | A1 | 6/2019 | Chun et al. |
| 2019/0317167 | A1 | 10/2019 | LaBorde et al. |
| 2020/0071190 | A1 | 3/2020 | Wiederin et al. |
| 2020/0139273 | A1 | 5/2020 | Badiei |
| 2020/0173679 | A1 | 6/2020 | O'Reilly et al. |
| 2020/0206669 | A1 | 7/2020 | Quanci et al. |
| 2020/0206683 | A1 | 7/2020 | Quanci et al. |
| 2020/0208058 | A1 | 7/2020 | Quanci et al. |
| 2020/0208059 | A1 | 7/2020 | Quanci et al. |
| 2020/0208060 | A1 | 7/2020 | Quanci et al. |
| 2020/0208063 | A1 | 7/2020 | Quanci et al. |
| 2020/0208833 | A1 | 7/2020 | Quanci et al. |
| 2020/0407641 | A1 | 12/2020 | Quanci et al. |
| 2021/0024828 | A1 | 1/2021 | Ball et al. |
| 2021/0040391 | A1 | 2/2021 | Quanci et al. |
| 2021/0130697 | A1 | 5/2021 | Quanci et al. |
| 2021/0163821 | A1 | 6/2021 | Quanci et al. |
| 2021/0163822 | A1 | 6/2021 | Quanci et al. |
| 2021/0163823 | A1 | 6/2021 | Quanci et al. |
| 2021/0198579 | A1 | 7/2021 | Quanci et al. |
| 2021/0340454 | A1 | 11/2021 | Quanci et al. |
| 2021/0363426 | A1 | 11/2021 | West et al. |
| 2021/0363427 | A1 | 11/2021 | Quanci et al. |
| 2021/0371752 | A1 | 12/2021 | Quanci et al. |
| 2021/0388270 | A1 | 12/2021 | Choi et al. |
| 2022/0056342 | A1 | 2/2022 | Quanci et al. |
| 2022/0298423 | A1 | 9/2022 | Quanci et al. |
| 2022/0325183 | A1 | 10/2022 | Quanci et al. |
| 2022/0356410 | A1 | 11/2022 | Quanci et al. |
| 2023/0012031 | A1 | 1/2023 | Quanci et al. |

FOREIGN PATENT DOCUMENTS

| | | | |
|---|---|---|---|
| CA | 2822841 | | 7/2012 |
| CA | 2822857 | | 7/2012 |
| CA | 2905110 | A1 | 9/2014 |
| CN | 87212113 | U | 6/1988 |
| CN | 87107195 | A | 7/1988 |
| CN | 2064363 | U | 10/1990 |
| CN | 2139121 | Y | 7/1993 |
| CN | 1092457 | A | 9/1994 |
| CN | 1255528 | A | 6/2000 |
| CN | 1270983 | A | 10/2000 |
| CN | 2528771 | Y | 2/2002 |
| CN | 1358822 | A | 7/2002 |
| CN | 2521473 | Y | 11/2002 |
| CN | 1468364 | A | 1/2004 |
| CN | 1527872 | A | 9/2004 |
| CN | 2668641 | | 1/2005 |
| CN | 1957204 | A | 5/2007 |
| CN | 101037603 | A | 9/2007 |
| CN | 101058731 | A | 10/2007 |
| CN | 101157874 | A | 4/2008 |
| CN | 101211495 | A | 7/2008 |
| CN | 201121178 | Y | 9/2008 |
| CN | 101395248 | A | 3/2009 |
| CN | 100510004 | C | 7/2009 |
| CN | 101486017 | A | 7/2009 |
| CN | 201264981 | Y | 7/2009 |
| CN | 101497835 | A | 8/2009 |
| CN | 101509427 | A | 8/2009 |
| CN | 101886466 | A | 11/2010 |
| CN | 101910530 | A | 12/2010 |
| CN | 102072829 | A | 5/2011 |
| CN | 102155300 | A | 8/2011 |
| CN | 2509188 | Y | 11/2011 |
| CN | 202226816 | | 5/2012 |
| CN | 202265541 | U | 6/2012 |
| CN | 102584294 | A | 7/2012 |
| CN | 202415446 | U | 9/2012 |
| CN | 202470353 | U | 10/2012 |
| CN | 103399536 | A | 11/2013 |
| CN | 103468289 | A | 12/2013 |
| CN | 103913193 | A | 7/2014 |
| CN | 203981700 | U | 12/2014 |
| CN | 104498059 | A | 4/2015 |
| CN | 105137947 | A | 12/2015 |
| CN | 105189704 | A | 12/2015 |
| CN | 105264448 | A | 1/2016 |
| CN | 105467949 | A | 4/2016 |
| CN | 106661456 | A | 5/2017 |
| CN | 106687564 | A | 5/2017 |
| CN | 107445633 | A | 12/2017 |
| CN | 100500619 | C | 6/2020 |
| DE | 201729 | C | 9/1908 |
| DE | 212176 | | 7/1909 |
| DE | 1212037 | B | 3/1966 |
| DE | 2720688 | A1 | 11/1978 |
| DE | 3231697 | C1 | 1/1984 |
| DE | 3328702 | A1 | 2/1984 |
| DE | 3315738 | C2 | 3/1984 |
| DE | 3329367 | C | 11/1984 |
| DE | 3407487 | C1 | 6/1985 |
| DE | 19545736 | | 6/1997 |
| DE | 19803455 | | 8/1999 |
| DE | 10122531 | A1 | 11/2002 |
| DE | 10154785 | | 5/2003 |
| DE | 102005015301 | | 10/2006 |
| DE | 102006004669 | | 8/2007 |
| DE | 102006026521 | | 12/2007 |
| DE | 102009031436 | | 1/2011 |
| DE | 102011052785 | | 12/2012 |
| EA | 010510 | B1 | 10/2008 |
| EP | 0126399 | A1 | 11/1984 |
| EP | 0208490 | A1 | 1/1987 |
| EP | 0903393 | A2 | 3/1999 |
| EP | 1538503 | A1 | 6/2005 |
| EP | 1860034 | A1 | 11/2007 |
| EP | 2295129 | A1 | 3/2011 |
| EP | 2468837 | A1 | 6/2012 |
| FR | 2339664 | | 8/1977 |
| FR | 2517802 | | 6/1983 |
| FR | 2764978 | | 12/1998 |
| GB | 364236 | A | 1/1932 |
| GB | 368649 | A | 3/1932 |
| GB | 441784 | | 1/1936 |
| GB | 606340 | | 8/1948 |
| GB | 611524 | | 11/1948 |
| GB | 725865 | | 3/1955 |
| GB | 871094 | | 6/1961 |
| GB | 923205 | A | 5/1963 |
| JP | S50148405 | | 11/1975 |
| JP | S5319301 | A | 2/1978 |

(56) References Cited

FOREIGN PATENT DOCUMENTS

| | | | |
|---|---|---|---|
| JP | 54054101 | | 4/1979 |
| JP | S5453103 | A | 4/1979 |
| JP | 57051786 | | 3/1982 |
| JP | 57051787 | | 3/1982 |
| JP | 57083585 | | 5/1982 |
| JP | 57090092 | | 6/1982 |
| JP | S57172978 | A | 10/1982 |
| JP | 58091788 | | 5/1983 |
| JP | 59051978 | | 3/1984 |
| JP | 59053589 | | 3/1984 |
| JP | 59071388 | | 4/1984 |
| JP | 59108083 | | 6/1984 |
| JP | 59145281 | | 8/1984 |
| JP | 60004588 | | 1/1985 |
| JP | 61106690 | | 5/1986 |
| JP | 62011794 | | 1/1987 |
| JP | 62285980 | | 12/1987 |
| JP | 01103694 | | 4/1989 |
| JP | 01249886 | | 10/1989 |
| JP | H0319127 | | 3/1991 |
| JP | 03197588 | | 8/1991 |
| JP | 04159392 | | 6/1992 |
| JP | H04178494 | A | 6/1992 |
| JP | H05230466 | A | 9/1993 |
| JP | H0649450 | A | 2/1994 |
| JP | H0654753 | U | 7/1994 |
| JP | H06264062 | | 9/1994 |
| JP | H06299156 | A | 10/1994 |
| JP | 07188668 | | 7/1995 |
| JP | 07216357 | | 8/1995 |
| JP | H07204432 | | 8/1995 |
| JP | H08104875 | A | 4/1996 |
| JP | 08127778 | | 5/1996 |
| JP | H10273672 | A | 10/1998 |
| JP | H11131074 | | 5/1999 |
| JP | H11256166 | A | 9/1999 |
| JP | 2000204373 | A | 7/2000 |
| JP | 2000219883 | A | 8/2000 |
| JP | 2001055576 | A | 2/2001 |
| JP | 2001200258 | | 7/2001 |
| JP | 2002097472 | A | 4/2002 |
| JP | 2002106941 | | 4/2002 |
| JP | 2003041258 | | 2/2003 |
| JP | 2003051082 | A | 2/2003 |
| JP | 2003071313 | A | 3/2003 |
| JP | 2003292968 | A | 10/2003 |
| JP | 2003342581 | A | 12/2003 |
| JP | 2004169016 | A | 6/2004 |
| JP | 2005503448 | A | 2/2005 |
| JP | 2005135422 | A | 5/2005 |
| JP | 2005154597 | A | 6/2005 |
| JP | 2005263983 | A | 9/2005 |
| JP | 2005344085 | A | 12/2005 |
| JP | 2006188608 | A | 7/2006 |
| JP | 2007063420 | A | 3/2007 |
| JP | 4101226 | B2 | 6/2008 |
| JP | 2008231278 | A | 10/2008 |
| JP | 2009019106 | A | 1/2009 |
| JP | 2009073864 | A | 4/2009 |
| JP | 2009073865 | A | 4/2009 |
| JP | 2009135276 | A | 6/2009 |
| JP | 2009144121 | | 7/2009 |
| JP | 2010229239 | A | 10/2010 |
| JP | 2010248389 | A | 11/2010 |
| JP | 2011504947 | A | 2/2011 |
| JP | 2011068733 | A | 4/2011 |
| JP | 2011102351 | A | 5/2011 |
| JP | 2012102302 | | 5/2012 |
| JP | 2013006957 | A | 1/2013 |
| JP | 2013510910 | | 3/2013 |
| JP | 2013189322 | A | 9/2013 |
| JP | 2014040502 | A | 3/2014 |
| JP | 2015094091 | A | 5/2015 |
| JP | 2016169897 | A | 9/2016 |
| KR | 1019960008754 | | 10/1996 |
| KR | 19990017156 | U | 5/1999 |
| KR | 1019990054426 | | 7/1999 |
| KR | 20000042375 | A | 7/2000 |
| KR | 100296700 | B1 | 10/2001 |
| KR | 20030012458 | A | 2/2003 |
| KR | 1020040020883 | A | 3/2004 |
| KR | 20040107204 | A | 12/2004 |
| KR | 20050053861 | A | 6/2005 |
| KR | 20060132336 | A | 12/2006 |
| KR | 100737393 | B1 | 7/2007 |
| KR | 100797852 | | 1/2008 |
| KR | 20080069170 | A | 7/2008 |
| KR | 20110010452 | A | 2/2011 |
| KR | 101314288 | | 4/2011 |
| KR | 20120033091 | A | 4/2012 |
| KR | 20130050807 | | 5/2013 |
| KR | 101318388 | | 10/2013 |
| KR | 20140042526 | A | 4/2014 |
| KR | 20150011084 | A | 1/2015 |
| KR | 20170038102 | A | 4/2017 |
| KR | 20170058808 | A | 5/2017 |
| KR | 20170103857 | A | 9/2017 |
| KR | 101862491 | B1 | 5/2018 |
| RU | 2083532 | C1 | 7/1997 |
| RU | 2441898 | C2 | 2/2012 |
| RU | 2493233 | C2 | 9/2013 |
| SU | 1535880 | A1 | 1/1990 |
| TW | 201241166 | A1 | 10/2012 |
| TW | 201245431 | A1 | 11/2012 |
| UA | 50580 | | 10/2002 |
| WO | WO9012074 | | 10/1990 |
| WO | WO9945083 | | 9/1999 |
| WO | WO02062922 | | 8/2002 |
| WO | WO2005023649 | | 3/2005 |
| WO | WO2005031297 | | 4/2005 |
| WO | WO2005115583 | | 12/2005 |
| WO | WO2007103649 | | 9/2007 |
| WO | WO2008034424 | | 3/2008 |
| WO | WO2008105269 | | 9/2008 |
| WO | WO2011000447 | | 1/2011 |
| WO | WO2011126043 | | 10/2011 |
| WO | WO2012029979 | | 3/2012 |
| WO | WO2012031726 | | 3/2012 |
| WO | WO2013023872 | | 2/2013 |
| WO | WO2010107513 | | 9/2013 |
| WO | WO2014021909 | | 2/2014 |
| WO | WO2014043667 | | 3/2014 |
| WO | WO2014105064 | | 7/2014 |
| WO | WO2014153050 | | 9/2014 |
| WO | WO2016004106 | | 1/2016 |
| WO | WO2016033511 | | 3/2016 |
| WO | WO2016086322 | | 6/2016 |

OTHER PUBLICATIONS

U.S. Appl. No. 17/363,701, filed Jun. 30, 2021, Quanci et al.
U.S. Appl. No. 17/459,380, filed Aug. 27, 2021, Quanci et al.
U.S. Appl. No. 17/471,491, filed Sep. 10, 2021, West et al.
U.S. Appl. No. 17/521,061, filed Nov. 8, 2021, Crum et al.
U.S. Appl. No. 17/526,477, filed Nov. 15, 2021, Quanci et al.
U.S. Appl. No. 17/532,058, filed Nov. 22, 2021, Quanci et al.
ASTM D5341-99 (2010) e1, Standard Test Method for Measuring Coke Reactivity Index (CRI) and Coke Strength After Reaction (CSR), ASTM International, West Conshohocken, PA, 2010.
Astrom, et al., "Feedback Systems: An Introduction for Scientists and Engineers," Sep. 16, 2006, available on line at http://people/duke.edu/-hpgavin/SystemID/References/Astrom-Feedback-2006.pdf; 404 pages.
Basset et al., "Calculation of steady flow pressure loss coefficients for pipe junctions," Proc Instn Mech Engrs., vol. 215, Part C, p. 861-881 IMechIE 2001.
Beckman et al., "Possibilities and limits of cutting back coking plant output," Stahl Und Eisen, Verlag Stahleisen, Dusseldorf, DE, vol. 130, No. 8, Aug. 16, 2010, pp. 57-67.
Bloom, et al., "Modular cast block—The future of coke oven repairs," Iron & Steel Technol, AIST, Warrendale, PA, vol. 4, No. 3, Mar. 1, 2007, pp. 61-64.

(56) References Cited

OTHER PUBLICATIONS

Boyes, Walt. (2003), Instrumentation Reference Book (3rd Edition)—34.7.4.6 Infrared and Thermal Cameras, Elsevier. Online version available at: https://app.knovel.com/hotlink/pdf/id:kt004QMGV6/instrumentation-reference-2/ditigal-video.
Clean coke process: process development studies by USS Engineers and Consultants, Inc., Wisconsin Tech Search, request date Oct. 5, 2011, 17 pages.
"Conveyor Chain Designer Guild", Mar. 27, 2014 (date obtained from wayback machine), Renold.com, Section 4, available online at: http://www.renold/com/upload/renoldswitzerland/conveyor_chain_-_designer_guide.pdf.
Costa, et al., "Edge Effects on the Flow Characteristics in a 90 deg Tee Junction," Transactions of the ASME, Nov. 2006, vol. 128, pp. 1204-1217.
Crelling, et al., "Effects of Weathered Coal on Coking Properties and Coke Quality", Fuel, 1979, vol. 58, Issue 7, pp. 542-546.
Database WPI, Week 199115, Thomson Scientific, Lond, GB; AN 1991-107552.
Diez, et al., "Coal for Metallurgical Coke Production: Predictions of Coke Quality and Future Requirements for Cokemaking", International Journal of Coal Geology, 2002, vol. 50, Issue 1-4, pp. 389-412.
Industrial Furnace Design Handbook, Editor-in-Chief: First Design Institute of First Ministry of Machinery Industry, Beijing: Mechanical Industry Press, pp. 180-183, Oct. 1981.
Joseph, B., "A tutorial on inferential control and its applications," Proceedings of the 1999 American Control Conference (Cat. No. 99CH36251), San Diego, CA, 1999, pp. 3106-3118 vol. 5.
Kerlin, Thomas (1999), Practical Thermocouple Thermometry—1.1 The Thermocouple. ISA. Online version available at https:app.knovel.com/pdf/id:kt007XPTM3/practical-thermocouple/the-thermocouple.
Kochanski et al., "Overview of Uhde Heat Recovery Cokemaking Technology," AISTech Iron and Steel Technology Conference Proceedings, Association for Iron and Steel Technology, U.S., vol. 1, Jan. 1, 2005, pp. 25-32.
Knoerzer et al. "Jewell-Thompson Non-Recovery Cokemaking", Steel Times, Fuel & Metallurgical Journals Ltd. London, GB, vol. 221, No. 4, Apr. 1, 1993, pp. 172-173,184.
Madias, et al., "A review on stamped charging of coals" (2013). Available at https://www.researchgate.net/publication/263887759_A_review_on_stamped_charging_of_coals.
Metallurgical Coke MSDS, ArcelorMittal, May 30, 2011, available online at http://dofasco.arcelormittal.com/-/media/Files/A/Arcelormittal-Canada/material-safety/metallurgical-coke.pdf.
"Middletown Coke Company HRSG Maintenance BACT Analysis Option 1—Individual Spray Quenches Sun Heat Recovery Coke Facility Process Flow Diagram Middletown Coke Company 100 Oven Case #1—24.5 VM", (Sep. 1, 2009), URL: http://web.archive.org/web/20090901042738/http://epa.ohio.gov/portals/27/transfer/ptiApplication/mcc/new/262504.pdf, (Feb. 12, 2016), XP055249803 [X] 1-13 * p. 7 * * pp. 8-11 *.
Practical Technical Manual of Refractories, Baoyu Hu, etc., Beijing: Metallurgical Industry Press, Chapter 6; 2004, 6-30.
Refractories for Ironmaking and Steelmaking: A History of Battles over High Temperatures; Kyoshi Sugita (Japan, Shaolin Zhang), 1995, p. 160, 2004, 2-29.
Rose, Harold J., "The Selection of Coals for the Manufacture of Coke," American Institute of Mining and Metallurgical Engineers, Feb. 1926, 8 pages.
Waddell, et al., "Heat-Recovery Cokemaking Presentation," Jan. 1999, pp. 1-25.
Walker D N et al, "Sun Coke Company's heat recovery cokemaking technology high coke quality and low environmental impact", Revue De Metallurgie—Cahiers D'Informations Techniques, Revue De Metallurgie. Paris, FR, (Mar. 1, 2003), vol. 100, No. 3, ISSN 0035-1563, p. 23.
Westbrook, "Heat-Recovery Cokemaking at Sun Coke," AISE Steel Technology, Pittsburg, PA, vol. 76, No. 1, Jan. 1999, pp. 25-28.
"What is dead-band control," forum post by user "wireaddict" on AllAboutCircuits.com message board, Feb. 8, 2007, accessed Oct. 24, 2018 at https:/forum.allaboutcircuits.com/threads/what-is-dead-band-control.4728/; 8 pages.
Yu et al., "Coke Oven Production Technology," Lianoning Science and Technology Press, first edition, Apr. 2014, pp. 356-358.
"Resources and Utilization of Coking Coal in China," Mingxin Shen ed., Chemical Industry Press, first edition, Jan. 2007, pp. 242-243, 247.
Canadian Office Action in Canadian Application No. 3,125,340; dated Aug. 13, 2021; 3 pages.
International Search Report and Written Opinion for PCT/US2019/068831; dated Apr. 29, 2020; 12 pages.
U.S. Appl. No. 17/584,672, filed Jan. 26, 2022, Quanci et al.
U.S. Appl. No. 07/587,742, filed Sep. 25, 1990, now U.S. Pat. No. 5,114,542, titled Nonrecovery Coke Oven Battery and Method of Operation.
U.S. Appl. No. 07/878,904, filed May 6, 1992, now U.S. Pat. No. 5,318,671, titled Method of Operation of Nonrecovery Coke Oven Battery.
U.S. Appl. No. 09/783,195, filed Feb. 14, 2001, now U.S. Pat. No. 6,596,128, titled Coke Oven Flue Gas Sharing.
U.S. Appl. No. 07/886,804, filed May 22, 1992, now U.S. Pat. No. 5,228,955, titled High Strength Coke Oven Wall Having Gas Flues Therein.
U.S. Appl. No. 08/059,673, filed May 12, 1993, now U.S. Pat. No. 5,447,606, titled Method of and Apparatus for Capturing Coke Oven Charging Emissions.
U.S. Appl. No. 08/914,140, filed Aug. 19, 1997, now U.S. Pat. No. 5,928,476, titled Nonrecovery Coke Oven Door.
U.S. Appl. No. 09/680,187, filed Oct. 5, 2000, now U.S. Pat. No. 6,290,494, titled Method and Apparatus for Coal Coking.
U.S. Appl. No. 10/933,866, filed Sep. 3, 2004, now U.S. Pat. No. 7,331,298, titled Coke Oven Rotary Wedge Door Latch.
U.S. Appl. No. 11/424,566, filed Jun. 16, 2006, now U.S. Pat. No. 7,497,930, titled Method and Apparatus for Compacting Coal for a Coal Coking Process.
U.S. Appl. No. 12/405,269, filed Mar. 17, 2009, now U.S. Pat. No. 7,998,316, titled Flat Push Coke Wet Quenching Apparatus and Process.
U.S. Appl. No. 13/205,960, filed Aug. 9, 2011, now U.S. Pat. No. 9,321,965, titled Flat Push Coke Wet Quenching Apparatus and Process.
U.S. Appl. No. 11/367,236, filed Mar. 3, 2006, now U.S. Pat. No. 8,152,970, titled Method and Apparatus for Producing Coke.
U.S. Appl. No. 12/403,391, filed Mar. 13, 2009, now U.S. Pat. No. 8,172,930, titled Cleanable In Situ Spark Arrestor.
U.S. Appl. No. 12/849,192, filed Aug. 3, 2010, now U.S. Pat. No. 9,200,225, titled Method and Apparatus for Compacting Coal for a Coal Coking Process.
U.S. Appl. No. 13/631,215, filed Sep. 28, 2012, now U.S. Pat. No. 9,683,740, titled Methods for Handling Coal Processing Emissions and Associated Systems and Devices.
U.S. Appl. No. 13/730,692, filed Dec. 28, 2012, now U.S. Pat. No. 9,193,913, titled Reduced Output Rate Coke Oven Operation With Gas Sharing Providing Extended Process Cycle.
U.S. Appl. No. 14/655,204, now U.S. Pat. No. 10,016,714, filed Jun. 24, 2015, titled Systems and Methods for Removing Mercury From Emissions.
U.S. Appl. No. 16/000,516, now U.S. Pat. No. 11,117,087, filed Jun. 5, 2018, titled Systems and Methods for Removing Mercury From Emissions.
U.S. Appl. No. 17/459,380, filed Jun. 5, 2018, titled Systems and Methods for Removing Mercury From Emissions.
U.S. Appl. No. 13/830,971, filed Mar. 14, 2013, now U.S. Pat. No. 10,047,296, titled Non-Perpendicular Connections Between Coke Oven Uptakes and a Hot Common Tunnel, and Associated Systems and Methods, now U.S. Pat. No. 10,047,295.
U.S. Appl. No. 16/026,363, filed Jul. 3, 2018, now U.S. Pat. No. 11,008,517, titled Non-Perpendicular Connections Between Coke Oven Uptakes and a Hot Common Tunnel, and Associated Systems and Methods.

(56) References Cited

OTHER PUBLICATIONS

U.S. Appl. No. 13/730,796, filed Dec. 28, 2012, now U.S. Pat. No. 10,883,051, titled Methods and Systems for Improved Coke Quenching.
U.S. Appl. No. 17/140,564, filed Jan. 4, 2021, titled Methods and Systems for Improved Coke Quenching.
U.S. Appl. No. 13/730,598, filed Dec. 28, 2012, now U.S. Pat. No. 9,238,778, titled Systems and Methods for Improving Quenched Coke Recovery.
U.S. Appl. No. 14/952,267, filed Nov. 25, 2015, now U.S. Pat. No. 9,862,888, titled Systems and Methods for Improving Quenched Coke Recovery.
U.S. Appl. No. 15/830,320, filed Dec. 4, 2017, now U.S. Pat. No. 10,323,192, titled Systems and Methods for Improving Quenched Coke Recovery.
U.S. Appl. No. 13/730,735, filed Dec. 28, 2012, now U.S. Pat. No. 9,273,249, titled Systems and Methods for Controlling Air Distribution in a Coke Oven.
U.S. Appl. No. 14/655,013, filed Jun. 23, 2015, now U.S. Pat. No. 11,142,699, titled Vent Stack Lids and Associated Systems and Methods.
U.S. Appl. No. 17/471,491, filed Sep. 10, 2021, now U.S. Pat. No. 11,142,699, titled Vent Stack Lids and Associated Systems and Methods.
U.S. Appl. No. 13/843,166, filed Mar. 15, 2013, now U.S. Pat. No. 9,273,250, titled Methods and Systems for Improved Quench Tower Design.
U.S. Appl. No. 15/014,547, filed Feb. 3, 2016, now, U.S. Pat. No. 10,927,303, titled Methods for Improved Quench Tower Design.
U.S. Appl. No. 17/155,818, filed Jan. 22, 2021, titled Methods and Systems for Improved Quench Tower Design.
U.S. Appl. No. 14/655,003, filed Jun. 23, 2015, now U.S. Pat. No. 10,760,002, titled Systems and Methods for Maintaining a Hot Car in a Coke Plant.
U.S. Appl. No. 16/897,957, filed Jun. 10, 2020, now U.S. Pat. No. 11,359,145, titled Systems and Methods for Maintaining a Hot Car in a Coke Plant.
U.S. Appl. No. 13/829,588, filed Mar. 14, 2013, now U.S. Pat. No. 9,193,915, titled Horizontal Heat Recovery Coke Ovens Having Monolith Crowns.
U.S. Appl. No. 15/322,176, filed Dec. 27, 2016, now U.S. Pat. No. 10,526,541, titled Horizontal Heat Recovery Coke Ovens Having Monolith Crowns.
U.S. Appl. No. 15/511,036, filed Mar. 14, 2017, now U.S. Pat. No. 10,968,383, titled Coke Ovens Having Monolith Component Construction.
U.S. Appl. No. 17/190,720, filed Mar. 3, 2021, titled Coke Ovens Having Monolith Component Construction.
U.S. Appl. No. 13/589,009, filed Aug. 17, 2012, now U.S. Pat. No. 9,359,554, titled Automatic Draft Control System for Coke Plants.
U.S. Appl. No. 15/139,568, filed Apr. 27, 2016, now U.S. Pat. No. 10,947,455, titled Automatic Draft Control System for Coke Plants.
U.S. Appl. No. 17/176,391, filed Feb. 16, 2021, titled Automatic Draft Control System for Coke Plants.
U.S. Appl. No. 13/588,996, filed Aug. 17, 2012, now U.S. Pat. No. 9,243,186, titled Coke Plant Including Exhaust Gas Sharing.
U.S. Appl. No. 14/959,450, filed Dec.4, 2015, now U.S. Pat. No. 10,041,002, titled Coke Plant Including Exhaust Gas Sharing.
U.S. Appl. No. 16/047,198, filed Jul. 27, 2018, now U.S. Pat. No. 10,611,965, titled Coke Plant Including Exhaust Gas Sharing.
U.S. Appl. No. 16/828,448, filed Mar. 24, 2020, now U.S. Pat. No. 11,441,077, titled Coke Plant Including Exhaust Gas Sharing.
U.S. Appl. No. 13/589,004, filed Aug. 17, 2012, now U.S. Pat. No. 9,249,357, titled Method and Apparatus for Volatile Matter Sharing in Stamp-Charged Coke Ovens.
U.S. Appl. No. 13/730,673, filed Dec. 28, 2012, now U.S. Pat. No. 9,476,547, titled Exhaust Flow Modifier, Duct Intersection Incorporating the Same, and Methods Therefor.
U.S. Appl. No. 15/281,891, filed Sep. 30, 2016, now U.S. Pat. No. 10,975,309, titled Exhaust Flow Modifier, Duck Intersection Incorporating the Same, and Methods Therefor.
U.S. Appl. No. 17/191,119, filed Mar. 3, 3021, titled Exhaust Flow Modifier, Duck Intersection Incorporating the Same, and Methods Therefor.
U.S. Appl. No. 13/598,394, filed Aug. 29, 2012, now U.S. Pat. No. 9,169,439, titled Method and Apparatus for Testing Coal Coking Properties.
U.S. Appl. No. 14/865,581, filed Sep. 25, 2015, now U.S. Pat. No. 10,053,627, titled Method and Apparatus for Testing Coal Coking Properties, now U.S. Pat. No. 10,053,627.
U.S. Appl. No. 14/839,384, filed Aug. 28, 2015, now U.S. Pat. No. 9,580,656, titled Coke Oven Charging System.
U.S. Appl. No. 15/443,246, filed Feb. 27, 2017, now U.S. Pat. No. 9,976,089, titled Coke Oven Charging System.
U.S. Appl. No. 14/587,670, filed Dec. 31, 2014, now U.S. Pat. No. 10,619,101, titled Methods for Decarbonizing Coking Ovens, and Associated Systems and Devices.
U.S. Appl. No. 16/845,530, filed Apr. 10, 2020, now U.S. Pat. No. 11,359,146, titled Methods for Decarbonizing Coking Ovens, and Associated Systems and Devices.
U.S. Appl. No. 14/984,489, filed Dec. 30, 2015, now U.S. Pat. No. 10,975,310, titled Multi-Modal Beds of Coking Material.
U.S. Appl. No. 14/983,837, filed Dec. 30, 2015, now U.S. Pat. No. 10,968,395, titled Multi-Modal Beds of Coking Material.
U.S. Appl. No. 14/986,281, filed Dec. 31, 2015, now U.S. Pat. No. 10,975,311, titled Multi-Modal Beds of Coking Material.
U.S. Appl. No. 17/222,886, filed Apr. 12, 2021, titled Multi- Modal Beds of Coking Material.
U.S. Appl. No. 14/987,625, filed Jan. 4, 2016, now U.S. Pat. No. 11,060,032, titled Integrated Coke Plant Automation and Optimization Using Advanced Control and Optimization Techniques.
U.S. Appl. No. 17/172,476, filed Feb. 10, 2021, titled Integrated Coke Plant Automation and Optimization Using Advanced Control and Optimization Techniques.
U.S. Appl. No. 14/839,493, filed Aug. 28, 2015, now U.S. Pat. No. 10,233,392, titled Method and System for Optimizing Coke Plant Operation and Output.
U.S. Appl. No. 16/251,352, filed Jan. 18, 2019, now U.S. Pat. No. 11,053,444, titled Method and System for Optimizing Coke Plant Operation and Output.
U.S. Appl. No. 14/839,551, filed Aug. 28, 2015, now U.S. Pat. No. 10,308,876, titled Burn Profiles for Coke Operations.
U.S. Appl. No. 16/428,014, filed May 31, 2019, now U.S. Pat. No. 10,920,148, titled Improved Burn Profiles for Coke Operations.
U.S. Appl. No. 17/155,719, filed Jan. 22, 2021, now U.S. Pat. No. 11,441,078, titled Improved Burn Profiles for Coke Operations.
U.S. Appl. No. 14/839,588, filed Aug. 28, 2015, now U.S. Pat. No. 9,708,542, titled Method and System for Optimizing Coke Plant Operation and Output.
U.S. Appl. No. 15/392,942, filed Dec. 28, 2016, now U.S. Pat. No. 10,526,542, titled Method and System for Dynamically Charging a Coke Oven.
U.S. Appl. No. 16/735,103, filed Jan. 6, 2020, now U.S. Pat. No. 11,214,739, titled Method and System for Dynamically Charging a Coke Oven.
U.S. Appl. No. 15/614,525, filed Jun. 5, 2017, now U.S. Pat. No. 11,508,230, titled Methods and Systems for Automatically Generating a Remedial Action in an Industrial Facility.
U.S. Appl. No. 18/047,916, filed Oct. 19, 2022, titled Methods and Systems for Automatically Generating a Remedial Action in an Industrial Facility.
U.S. Appl. No. 15/987,860, filed May 23, 2018, now U.S. Pat. No. 10,851,306, titled System and Method for Repairing a Coke Oven.
U.S. Appl. No. 17/076,563, filed Oct. 21, 2020, now U.S. Pat. No. 11,186,778, titled System and Method for Repairing a Coke Oven.
U.S. Appl. No. 17/521,061, filed Nov. 8, 2021, titled System and Method for Repairing a Coke Oven.
U.S. Appl. No. 17/135,483, filed Dec. 28, 2020, titled Oven Health Optimization Systems and Methods.
U.S. Appl. No. 16/729,053, filed Dec. 27, 2019, titled Oven Uptakes.

(56) References Cited

OTHER PUBLICATIONS

U.S. Appl. No. 16/729,036, filed Dec. 27, 2019, now U.S. Pat. No. 11,365,355, titled Systems and Methods for Treating a Surface of a Coke Plant.
U.S. Appl. No. 17/747,708, filed May 18, 2022, titled Systems and Methods for Treating a Surface of a Coke Plant.
U.S. Appl. No. 16/729,201, filed Dec. 27, 2019, titled Gaseous Tracer Leak Detection.
U.S. Appl. No. 16/729,122, filed Dec. 27, 2019, now US. Patent No. 11,395,989, titled Methods and Systems for Providing Corrosion Resistant Surfaces in Contaminant Treatment Systems.
U.S. Appl. No. 17/843,164, filed Jun. 17, 2022, titled Methods and Systems for Providing Corrosion Resistant Surfaces in Contaminant Treatment Systems.
U.S. Appl. No. 16/729,068, filed Dec. 27, 2019, titled Systems and Methods for Utilizing Flue Gas.
U.S. Appl. No. 17/947,520 filed Sep. 19, 2022, titled Systems and Methods for Utilizing Flue Gas.
U.S. Appl. No. 16/729,129, filed Dec. 27, 2019, now U.S. Pat. No. 11,008,518, titled Coke Plant Tunnel Repair and Flexible Joints.
U.S. Appl. No. 17/320,343, filed May 14, 2021, titled Coke Plant Tunnel Repair and Flexible Joints.
U.S. Appl. No. 16/729,170, now U.S. Pat. No. 11,193,069, filed Dec. 27, 2019, titled Coke Plant Tunnel Repair and Anchor Distribution.
U.S. Appl. No. 17/532,058, now U.S. Pat. No. 11,505,747, filed Nov. 22, 2021, titled Coke Plant Tunnel Repair and Anchor Distribution.
U.S. Appl. No. 17/967,615, filed Oct. 17, 2022, titled Coke Plant Tunnel Repair and Anchor Distribution.
U.S. Appl. No. 16/729,157, filed Dec. 27, 2019, now U.S. Pat. No. 11,071,935, titled Particulate Detection for Industrial Facilities, and Associated Systems and Methods.
U.S. Appl. No. 16/729,057, filed Dec. 27, 2019, now U.S. Pat. No. 11,021,655, titled Decarbonization of Coke Ovens and Associated Systems and Methods.
U.S. Appl. No. 17/321,857, filed May 17, 2021, titled Decarbonization of Coke Ovens and Associated Systems and Methods.
U.S. Appl. No. 16/729,212, filed Dec. 27, 2019, now U.S. Pat. No. 11,261,381, titled Heat Recovery Oven Foundation.
U.S. Appl. No. 17/584,672, filed Jan. 26, 2022, titled Heat Recovery Oven Foundation.
U.S. Appl. No. 16/729,219, now U.S. Pat. No. 11,098,252, filed Dec. 27, 2019, titled Spring-Loaded Heat Recovery Oven System and Method.
U.S. Appl. No. 17/736,960, filed May 20, 2022, titled Foundry Coke Products, and Associated Systems and Methods.
U.S. Appl. No. 17/306,895, filed May 3, 2021, titled High-Quality Coke Products.
U.S. Appl. No. 18/052,739, filed Nov. 4, 2022, titled Foundry Coke Products and Associated Processing Methods via Cupolas.
U.S. Appl. No. 18/052,760, filed Nov. 2, 2022, titled Foundry Coke Products, and Associated Systems, Devices, and Methods.
U.S. Appl. No. 17/947,520, filed Sep. 19, 2022, Quanci et al.
U.S. Appl. No. 17/967,615, filed Oct. 17, 2022, Quanci et al.
U.S. Appl. No. 18/047,916, filed Oct. 19, 2022, Quanci et al.
U.S. Appl. No. 18/052,739, filed Nov. 4, 2022, Quanci et al.
U.S. Appl. No. 18/052,760, filed Nov. 4, 2022, Quanci et al.
"High Alumina Cement-Manufacture, Characteristics and Uses," TheConstructor.org, https://theconstructor.org/concrete/high-alumina-cement/23686/; 12 pages.
"Refractory Castables," Victas.com, Dec. 28, 2011 (date obtained from WayBack Machine), https://www/vitcas.com/refactory-castables; 5 pages.
Tiwari, et al., "A novel technique for assessing the coking potential of coals/cole blends for non-recovery coke making process," Fuel, vol. 107, May 2013, pp. 615-622.

SPRING-LOADED HEAT RECOVERY OVEN SYSTEM AND METHOD

CROSS-REFERENCE TO RELATED APPLICATION

This application is a continuation of U.S. patent application Ser. No. 16/729,219, filed Dec. 27, 2019, which claims the benefit of U.S. Provisional Patent Application No. 62/786,325, filed Dec. 28, 2018, both disclosures of which are incorporated herein by reference in their entireties.

TECHNICAL FIELD

This disclosure relates to a spring-loaded system and method for maintaining compression on heat recovery or non-recovery ovens during thermal expansion and contraction of the ovens.

BACKGROUND

Coke is a solid carbon fuel and carbon source used to melt and reduce iron ore in the production of steel. In one process, known as the "Thompson Coking Process," coke is produced by batch feeding pulverized coal to an oven that is sealed and heated to very high temperatures for approximately forty-eight hours under closely-controlled atmospheric conditions. Coking ovens have been used for many years to convert coal into metallurgical coke. During the coking process, finely crushed coal is heated under controlled temperature conditions to devolatilize the coal and form a fused mass of coke having a predetermined porosity and strength.

Because coke ovens cycle between very high temperatures during the coking process and lower temperatures between coking processes, the ovens often undergo expansion and contraction. To avoid damage to the oven, structures that can maintain compression on the oven during this expansion and contraction are needed.

DETAILED DESCRIPTION

Figure 1A:
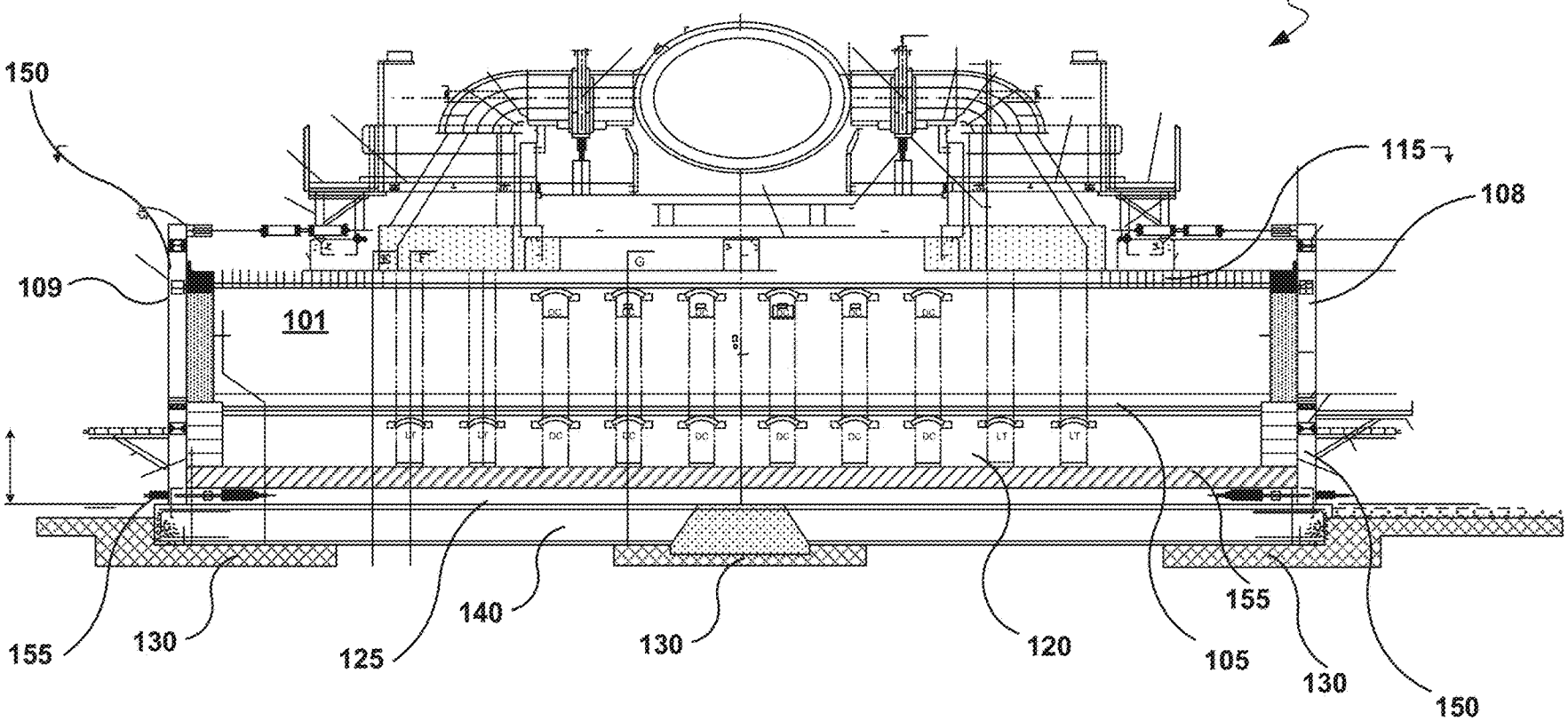
FIG. 1A is a cross-section view of a coke oven, according to one embodiment.

The present technology is generally directed to systems and methods for maintaining compression on coke ovens during thermal expansion and contraction of the ovens. A coke oven, which can be any of a variety of types of heat recovery ovens or non-recovery ovens, can include an oven body, a foundation, and a plurality of beams separating the oven body from the foundation. A buckstay applies force to the oven body to maintain compression on the oven body as the oven body expands and contracts during thermal cycling. The coke oven further comprises a spring-loaded compression device, which can include a restraining device, an anchor coupled to the restraining device, and a spring coupled to the restraining device. The anchor can be attached to one or more of the beams, the foundation of the oven, to a similar compression device on an opposite side of the oven, or to another object outside the oven. The spring applies force between the restraining device and the one or more beams or foundation to compress the buckstay against the oven.

Embodiments of the compression device described herein beneficially allow for expansion and contraction of the oven body as the oven is heated and cooled while maintaining compression on the oven. The compression device can maintain structural stability of the oven over a plurality of thermal cycles. Because the compression device can be coupled to either the foundation or the beams supporting the oven, the compression device design described herein does not need to be coupled to an opposite side of the oven in order to maintain compression the oven. For example, if space under the oven fills in (e.g., due to a beam collapsing), components of the compression device do not need to be threaded through the collapsed region. Rather, embodiments of the compression device described herein can be coupled to a structure on the same side of the oven at which the compression device is located. Various embodiments described herein also reduce interference with machines that operate at either end of the oven body. For example, embodiments of the compression device described herein maintain a low profile so as not to be hit by a machine that cleans material (coal or coke) that falls out of the oven. The components of the compression device can also be visually inspected to discover structural problems before any of the structures fail. Furthermore, although embodiments of the spring-loaded compression device are described herein as being used to maintain compression on heat recovery ovens, similar devices may be used for other types of ovens such as non-recovery ovens.

Specific details of several embodiments of the technology are described below with reference to FIGS. 1A-8B. Other details describing well-known structures and systems often associated with coke ovens have not been set forth in the following disclosure to avoid unnecessarily obscuring the description of the various embodiments of the technology. Many of the details, dimensions, angles, and other features shown in the Figures are merely illustrative of particular embodiments of the technology. Accordingly, other embodiments can have other details, dimensions, angles, and features without departing from the spirit or scope of the present technology. A person of ordinary skill in the art, therefore, will accordingly understand that the technology may have other embodiments with additional elements, or the technology may have other embodiments without several of the features shown and described below with reference to FIGS. 1A-8B.

Figure 1B:
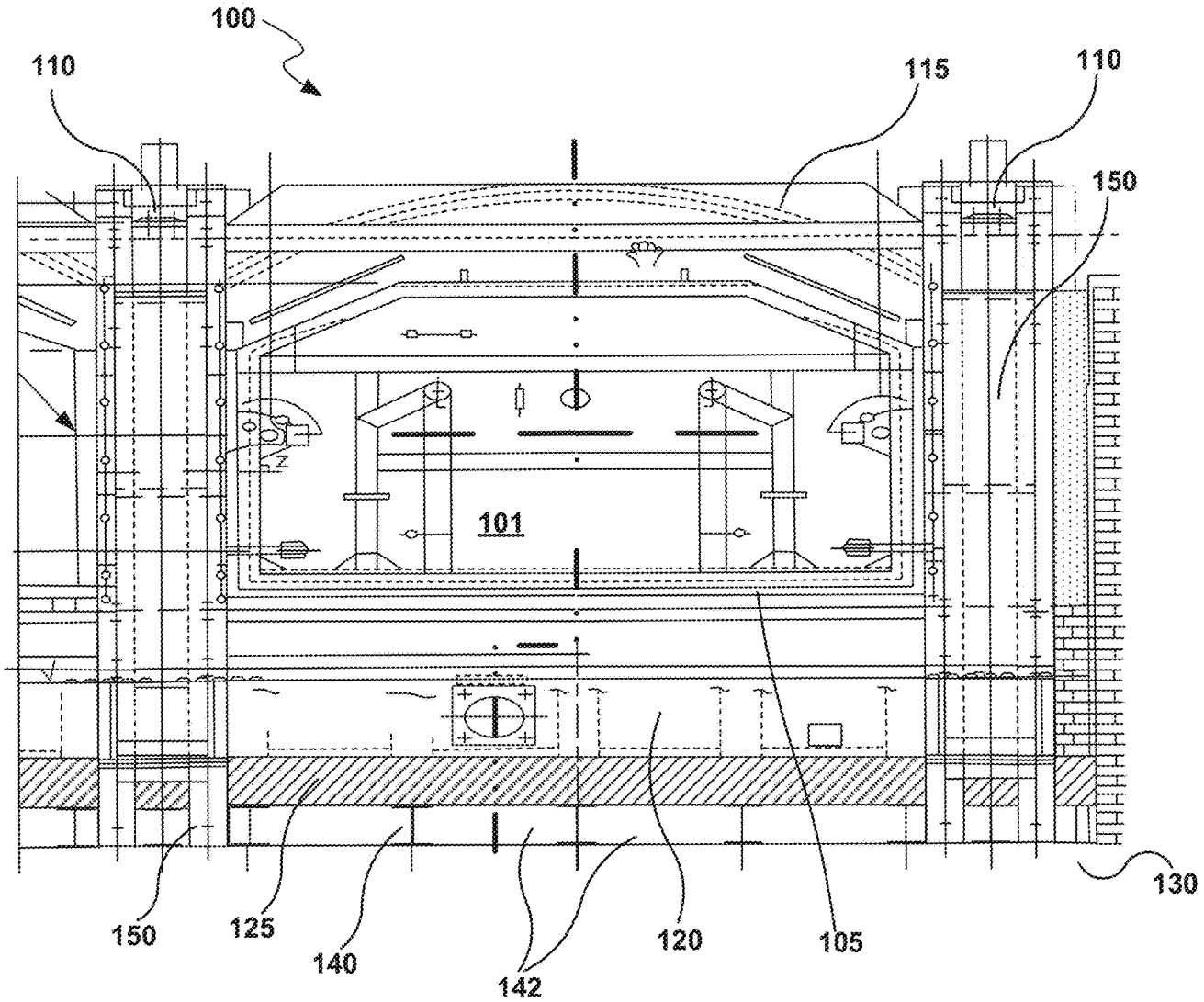
FIG. 1B is a front view of a coke oven.

FIG. 1A is a longitudinal cross-section view of a heat recovery coke oven 100 in accordance with embodiments of the disclosure, and FIG. 1B is a front view of the heat recovery oven 100. As shown in FIGS. 1A-1B, the oven 100 can include an open cavity (referred to herein as an oven chamber 101) defined by a floor 105, two sidewalls 110 extending upwardly from the oven floor 105, and a crown 115 that forms a top surface of the open cavity. A first end of the crown 115 can rest on a first sidewall 110 while a second end of the crown 115 can rest on an opposing, second sidewall 110. The oven can have a front door 108 and a rear door 109, which can be closed to seal the oven chamber 101. The oven 100 can be adjacent to other similar heat recovery ovens. Each adjacent oven can share a common sidewall 110 with the oven 100.

In operation, volatile gases emitted from heated coal in the oven 100 collect in the crown 115 and are drawn downstream into a sole flue 120 positioned beneath the oven floor 105. The sole flue 120 includes a plurality of side-by-side runs that form a circuitous path beneath the oven floor 105.

Coke is produced in the oven 100 by first loading coal into the oven chamber, heating the coal in an oxygen-depleted environment, driving off the volatile fraction of coal, and then oxidizing the volatile matter within the oven 100 to capture and utilize the heat given off. The coking cycle begins when coal is charged onto the oven floor 105 through the front door 108. The coal on the oven floor 105 is known as the coal bed. Heat from the oven 100, due to the previous coking cycle, starts a carbonization cycle. Roughly half of the total heat transfer to the coal bed is radiated down onto the top surface of the coal bed from the luminous flame of the coal bed and the crown 115. The remaining approximately half of the heat is transferred to the coal bed by conduction from the oven floor 105, which is convectively heated from the volatilization of gases in the sole flue 120. In this way, a carbonization process "wave" of plastic flow of the coal particles and formation of high strength cohesive coke proceeds from both the top and bottom boundaries of the coal bed. At the end of the coking cycle, the coal has coked out and has carbonized to produce coke. The coke can be removed from the oven 100 through the rear door 109 opposite the front door 108 using a mechanical extraction system. Finally, the coke is quenched and sized before delivery to a user.

Primary air for combustion can be added to the oven chamber 101 to partially oxidize coal volatiles, but the amount of primary air can be controlled so that only a portion of the volatiles released from the coal are corn busted in the oven chamber 101, thereby releasing only a fraction of their enthalpy of combustion within the oven chamber 101. The partially corn busted gases pass from the oven chamber 101 into the sole flue 120, where secondary air can be added to the partially corn busted gases. As the secondary air is introduced, the partially combusted gases are more fully combusted in the sole flue 120, thereby extracting the remaining enthalpy of combustion that can be conveyed through the oven floor 105 to add heat to the oven chamber 101. However, at least part of the heat produced by the combustion in the sole flue 120 is conveyed downward to structural components below the flue 120.

Beneath the sole flue 120 is a castable slab 125. The slab 125, comprising concrete, a ceramic, or other castable refractory, can form a bottom floor of the sole flue 120 and support the oven 100. The slab 125 can have a width that is approximately equal to the width of the oven 100, or the slab 125 can extend the width of multiple ovens.

The oven 100 is supported by a foundation 130, for example comprising concrete. Between the foundation 130 and the castable slab 125 are one or more beams 140 that form a plurality of air gaps 142 between the foundation and slab. The beams 140 an extend a length of the oven from a first end to a second end. For example, the beams 140 can extend from the front door 108 to the rear door 109. Each beam 140 can be a continuous structure extending the length of the oven 100, or two or more beams 140 placed end-to-end can together extend the length of the oven. The air gaps 142 can similarly extend the length of the oven 100. The air gaps 142 can be open at a first end of the oven 100 and a second end of the oven 100 opposite the first end, allowing air movement through the gaps 142 and around the beams 140. The beams 140 comprise a structural material capable of supporting the oven 100 while leaving air gaps 142 below the castable slab 125. In some embodiments, the beams 140 are manufactured out of a metal, such as steel.

As shown in FIG. 1B, the beams 140 in some embodiments can comprise I-beams. However, the beams 140 can take other shapes or configurations in other embodiments. For example, the beams 140 can include a hollow pipe with a rectangular cross-section, a solid tube with a rectangular cross-section, a brick, a combination of two or more of these structures (e.g., I-beams under some portions of the oven and bricks under other portions of the oven), or another structure that allows the beams 140 to be spaced apart from one another while supporting the weight of the oven 100 above the beams.

In various embodiments, the beams 140 can be between six inches and eighteen inches high (i.e., leaving a gap between the foundation 130 and the castable slab 125 that is between six and eighteen inches). For example, the beams 140 can have a height of eight inches or twelve inches. The height of the beams 140 may be selected based on material properties of the beams, as well as an amount of natural or forced air flow through the air gaps 142. For example, because taller beams allow more air to flow through the gaps 142 under natural airflow than shorter beams, taller beams can be used in circumstances where more natural cooling is desired. The beams 140 can have a distance between them that depends on structural capacity of each beam. The beams 140 may have uniform spacing under the ovens, or more beams can be placed under heavier components of the ovens while fewer beams are placed under lighter components. For example, the beams 140 can be closer together under the sidewalls 110 than they are under the sole flue 120. The air gaps created by the beams 140 can thermally isolate the oven body from the foundation 130 and/or improve heat dissipation from the oven body by allowing airflow under the oven body. The heat dissipation caused by the airflow reduces the temperature of the castable slab 125 and reduces heat transfer between the sole flue 120 and the foundation 130. Because the slab 125 or foundation 130 may fail at high temperatures, the dissipation of heat helps reduce the likelihood of failure of either component. Similarly, heat transferred to subgrade below the foundation 130, in particular if the subgrade includes a high proportion of slag, can cause the subgrade to become unstable. Reducing the heat transfer into the foundation 130 similarly reduces heat transfer to the subgrade and reduces the likelihood of the subgrade becoming unstable.

The air gaps created by the beams 140 enable air to flow around the beams 140 to reduce heat transfer between the slab 125 and the foundation and the cool the beams and other structures of the oven, such as a compression device. Depending on a location of the oven 100, natural air flow through the air gaps (e.g., due to wind) may be sufficient to cool the beams. However, in some embodiments, the oven 100 includes a forced cooling system that forces air a fluid can be forced through at least one of the air gaps between the beams 140 to increase convection and further reduce the amount of heat transfer from the sole flue 120 to the foundation 130. The forced cooling system can, for example, force air through an air gap using one or more fans, nozzles, air horns, air multipliers, air movers, or vacuums. Gases other than air may be forced through the air gaps instead of, or in addition to, air. As another example, the forced cooling system can include cooling pipes positioned in the air gaps, adjacent to the beams 140, or passing through the beams 140 or foundation 130. A cooling fluid can be pumped through the pipes continuously or on a periodic basis to dissipate heat from the beams 140.

Various other configurations of the beams 140 are described in U.S. patent application Ser. No. 16/729,212, filed Dec. 27, 2019, which claims the benefit of U.S. Provisional Patent Application No. 62/786,320, filed Dec. 28, 2018, both of which are incorporated herein by reference in their entirety.

The heat recovery coke oven 100 further includes buckstays 150. Each buckstay 150 comprises a mechanical structure that constrains movement of the oven 100, for example during thermal expansion and contraction. As shown in FIGS. 1A-1B, the oven 100 can include four buckstays 150: one on either lateral side of the front or "pusher" side of the oven, and one on either lateral side of the back or "coke" side of the oven. For example, the buckstays 150 can be positioned in front of or adjacent to the sidewalls 110 of the oven. Because adjacent ovens may share a sidewall 110, two buckstays 150 can be positioned in front of each sidewall. By way of example, during typical operation of some configurations of the heat recovery oven 100, the length of the oven can expand by about six inches between its lowest operating temperature and its highest operating temperature in a given thermal cycle. The buckstays 150 provide compression against the oven, reducing the likelihood of the oven failing as it expands and contracts.

Associated with each buckstay 150 is a spring-loaded compression device 155. The compression device 155 can be coupled to various components of the heat recovery oven 100, such as the foundation 130 or one or more beams 140, or to objects outside the oven 100, such as a flume. The compression device 155 applies force to the buckstay 150 to maintain compression of the buckstay against the oven. The compression device 155 can provide force against a single buckstay or multiple buckstays 150. For example, one compression device 155 can apply force to two adjacent buckstays 150 (e.g., a buckstay 150 positioned at the right sidewall 110 of a first oven, and a buckstay 150 positioned at a left sidewall 110 of a second oven to the right of the first oven). If the compression device 155 couples two buckstays 150, the compression device effectively can spring-load two adjacent ovens together. In some embodiments, the compression device 155 can be a bridle assembly.

The compression device 155 can include a restraining device, such as a bridle, and one or more springs. In some embodiments, the restraining device can pass over a buckstay 150 on an outside (away from the oven) or an inside (toward the oven) of the buckstay, without passing through the buckstay. Other embodiments of the restraining device can pass through the buckstay. The restraining device can be coupled to one more anchors that anchor the compression device, for example to the beams 140, the foundation 130, the castable slab 125, a compression device on an opposite side of the oven, or an object outside the oven. The restraining device and springs compress the buckstay 150 against the oven 100, while allowing the buckstay 150 to move as the oven expands or contracts. Various embodiments of the compression device 155 are illustrated in FIGS. 2A-8B.

In some embodiments, as shown for example in FIG. 1A, the oven 100 has a first compression device 155 at a first end of the oven 100 and a second compression device 155 at a second end of the oven. The second compression device 155 can be physically separate from the first compression device 155, such that the second compression device 155 is not connected to the first compression device 155. For example, there is no tie rod connecting the second compression device to the first compression device that applies force between the first and second compression devices. Rather, the first and second compression devices are each anchored to the beams 140 and/or foundation 130, allowing the beams 140 or foundation 130 to act as a structural element that resists horizontal expansion of the oven 100 in addition to supporting the weight of the oven 100. The arrangement of two physically separate compression devices shown in FIG. 1A can be advantageous, for example, because a tie rod does not need to pass through obstructed regions under the oven.

The first and second compression devices 155 can both be spring-loaded compression devices, in which a spring applies force to a component of the compression device to compress a the buckstay 150 against the oven body. In other cases, one compression device can be spring-loaded while the other compression device is fixed. For example, the fixed compression device can be welded or otherwise attached to the buckstay 150 while the buckstay 150 is welded or otherwise attached to a beam 140.

Figure 2A:
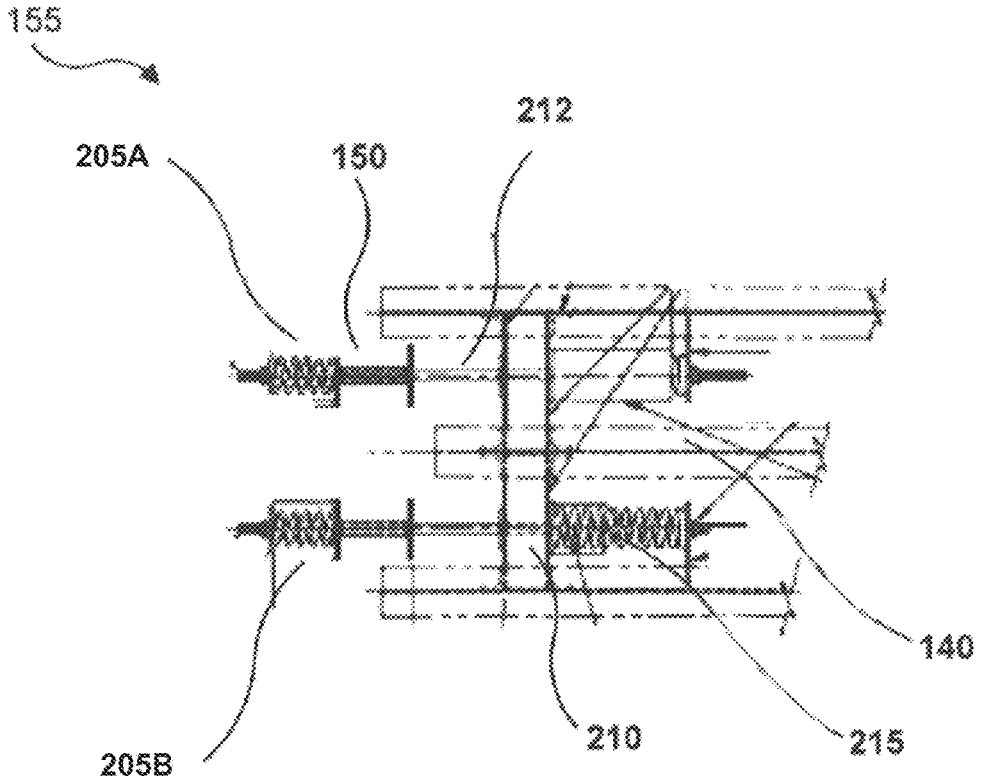
FIGS. 2A-2C illustrate an example compression device for a coke oven.
Figure 2B:
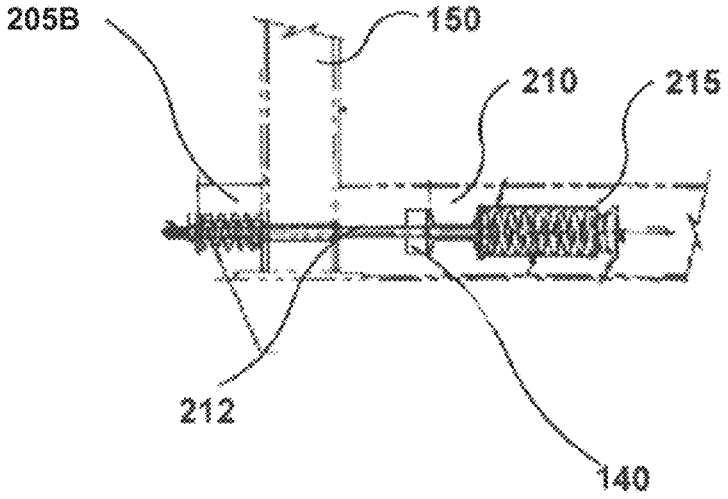
Figure 2C:
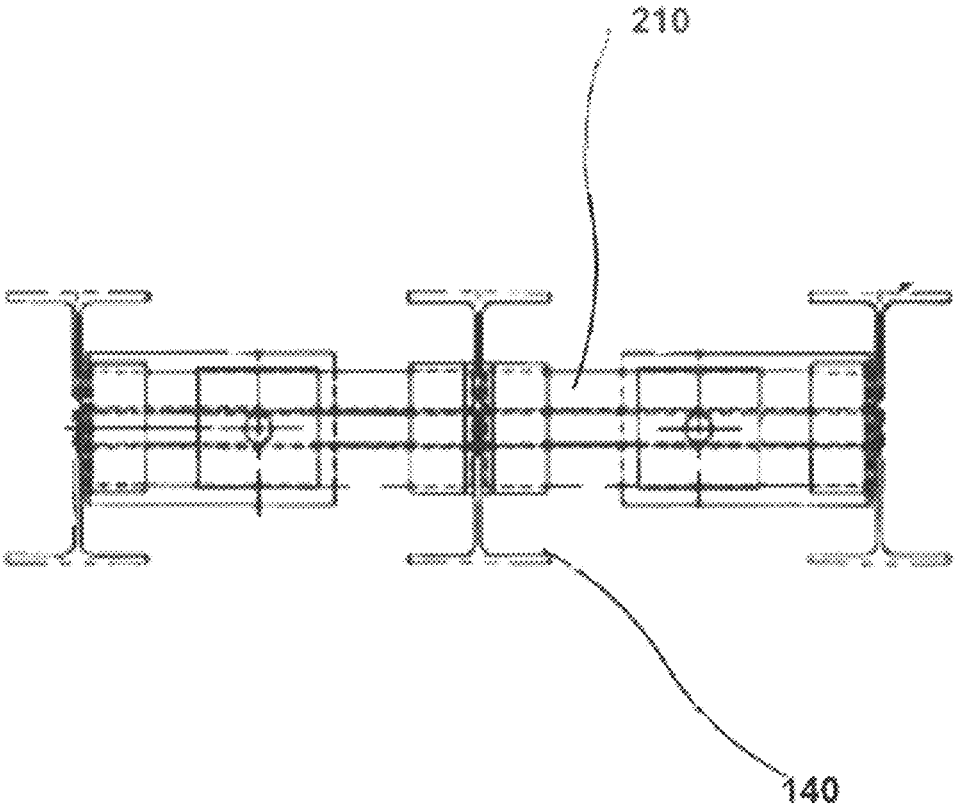

FIGS. 2A-2C illustrate top, side, and front views respectively of a first example compression device 155. As shown in FIGS. 2A-2C, the compression device 155 can include two springs 205, each positioned on an outside of a buckstay 150 (i.e., on a side away from the oven 100). The springs 205 are compressed against the buckstays 150 and are coupled to a restraining device 210 by a connecting rod 212. The restraining device 210 can pass through a hole in at least one beam 140 under the oven 100 and is anchored against the beam. A third spring 215 can compress the restraining device 210 against the beam 140. Other embodiments of the compression device 155 may omit the third spring 215, or may include an additional spring compressing the restraining device 210 against the beam 140 (e.g., opposite the spring 205A in FIG. 2A), The springs 205, 215 allow the buckstay 150 to move as the oven 100 expands and contracts, but provide force compressing the buckstay 150 against the oven 100.

Figure 3A:
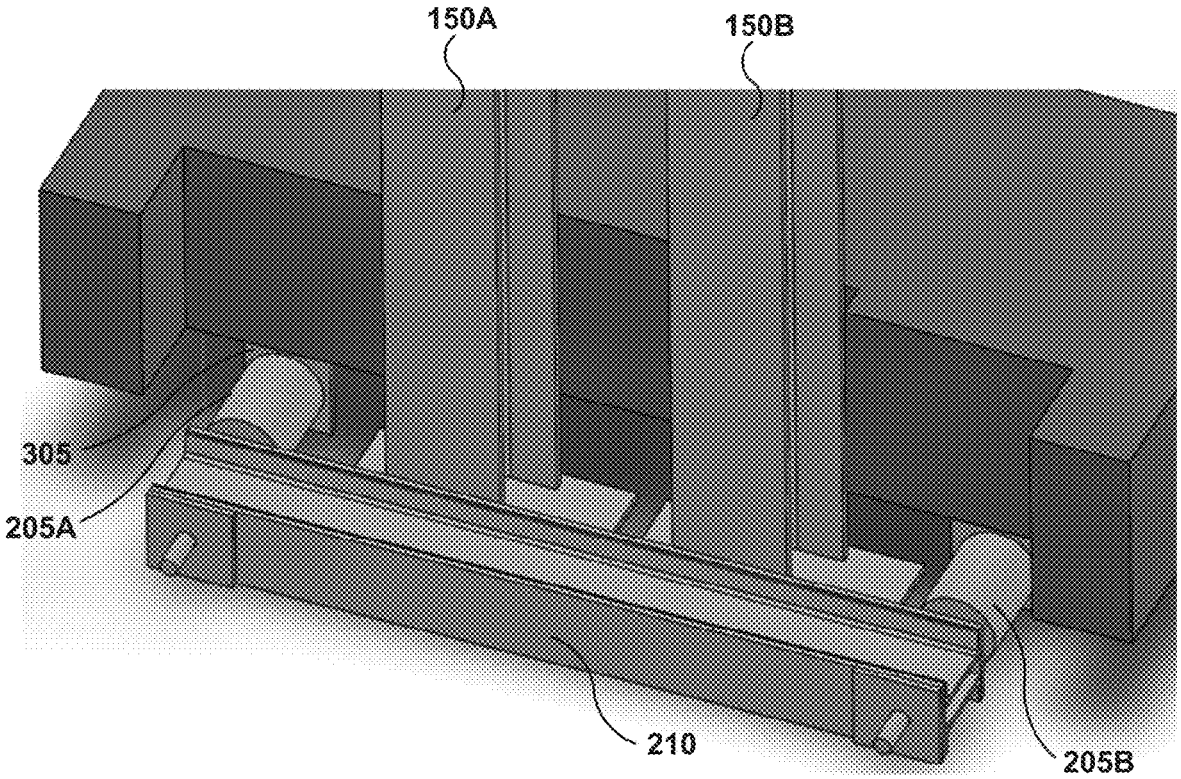
FIGS. 3A-3B illustrate another example compression device.
Figure 3B:
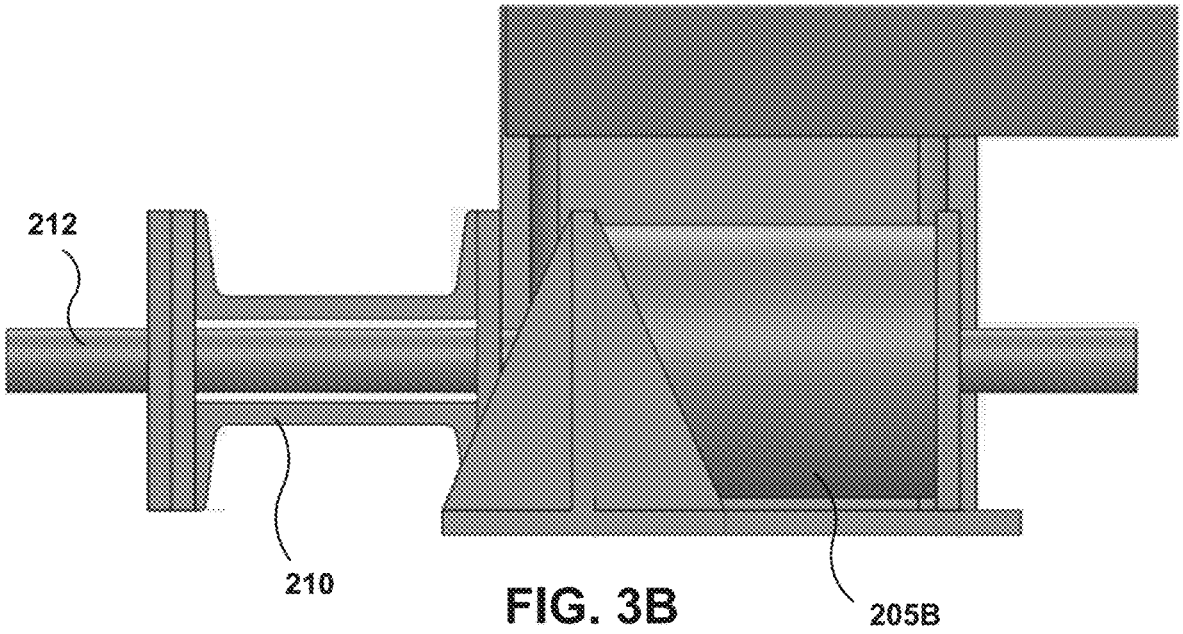

FIGS. 3A-3B are a front elevation and side view of another example compression device 155. The compression device 155 shown in FIGS. 3A-3B can also include two springs 205 coupled to a restraining device 210 by a connecting rod 212. The restraining device 210 is positioned on an outside of the buckstays 150, and can be anchored to the foundation 130 to pull the compression device 155 against the buckstays 150. The springs 205 can be coupled to the restraining device 210 on opposite sides of one or more buckstays 150, such that one spring 205 is on each side of the one or more buckstays 150. In the example of FIG. 3A, the restraining device 210 is a bridle that passes over two adjacent buckstays 150 (e.g., each supporting an adjacent oven), and the springs 205 are positioned such that a first spring 205A is on a first side of a first buckstay 150A and a second spring 205B is on a second side of a second buckstay 150B. However, a similar structure for the compression device 155 can be used to constrain a single buckstay 150 against the oven body. An anchor 305, such as a plate, coupled to each spring can anchor the compression device 155 to the foundation 130. For example, the anchor 305 can be drilled into the foundation 130, or can be attached to a plate or rod that is drilled into or otherwise coupled to the foundation.

In the example compression device 155 configuration shown in FIGS. 3A-3B, the buckstays 150 can be approximately centered between the springs 205. However, the springs 205 can have different distances from the buckstays 150. For example, if the foundation 130 is cracked near a right side of the buckstays 150 shown in FIGS. 3A-3B but not cracked near the left side, an anchor coupling the right side of the compression device 155 to the foundation may be placed farther away from the buckstays 150 (where the foundation is not cracked) than the anchor coupling the left side of the compression device to the foundation. A length of the restraining device 210 may be extended toward the right side of the buckstays to accommodate the placement of the anchor.

Figure 4A:
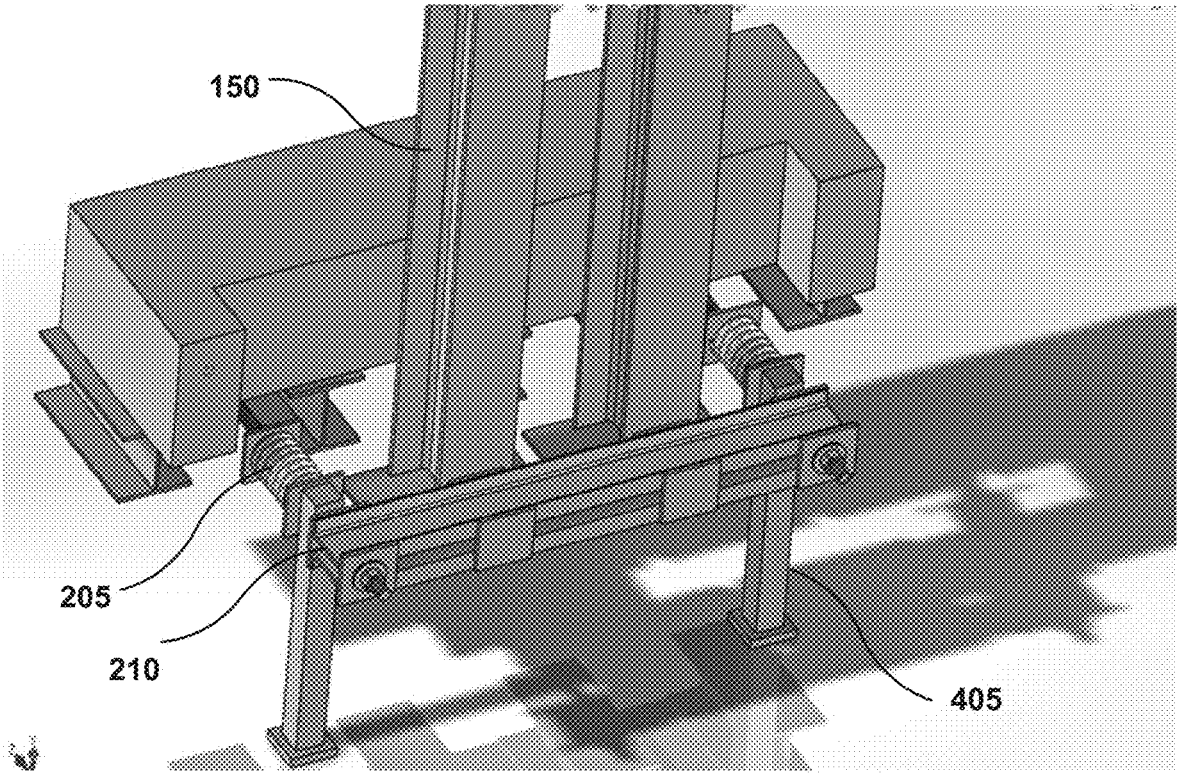
FIGS. 4A-4B illustrate another example compression device.
Figure 4B:
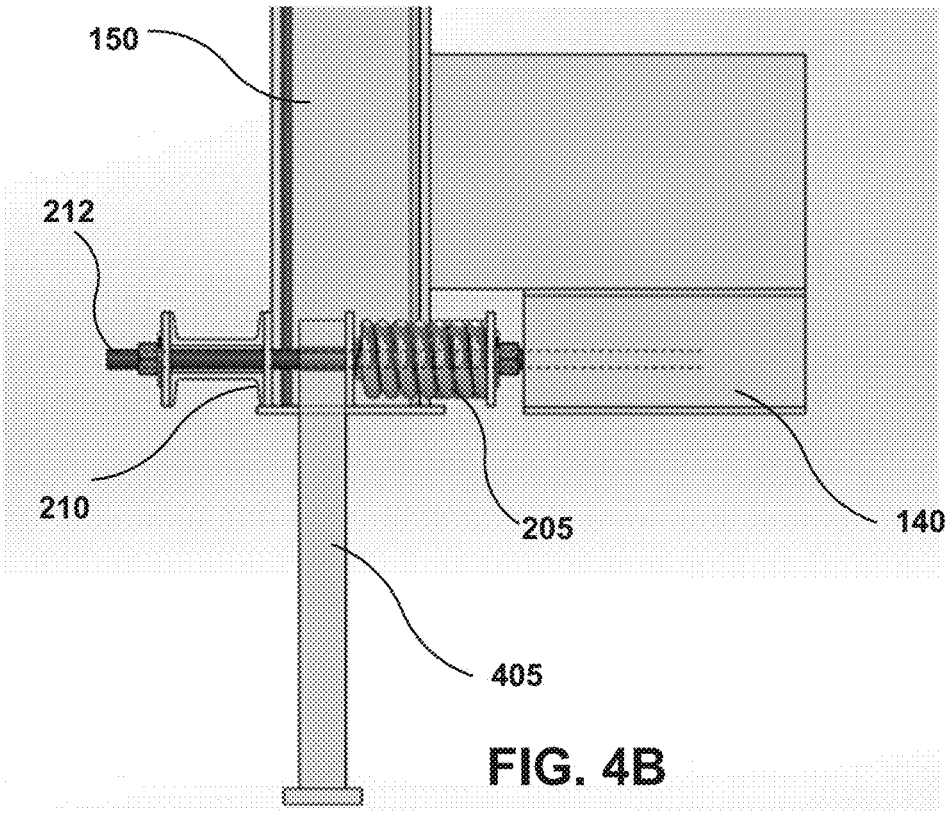

FIGS. 4A-4B are a front elevation and side view of another example compression device 155. Like the example shown in FIGS. 3A-3B, the example shown in FIGS. 4A-4B can include two springs 205 coupled to a restraining device 210 on opposite sides of one or more buckstays 150, and the restraining device 210 can be positioned on an outside of the buckstays 150. The restraining device 210 can be anchored to a beam 140 by the connecting rod 212 to pull the compression device 155 against the buckstays 150. The restraining device 210 can be anchored to beams 140 adjacent to the buckstays 150 on either side of the buckstays, or to beams 140 some distance away from the buckstays 150. For example, if the beams 140 adjacent to the buckstay are damaged or structurally unsound, the restraining device 210 can be anchored into a structurally sound beam that is farther from the buckstays. The restraining device 210 can have a length that is approximately equivalent to a length between the beams 140 to which the restraining device is anchored. An anchoring beam 405 coupled to the restraining device 210 can extend downward from the restraining device 210 and can be anchored into the foundation 130 below the buckstay 150. For example, if the foundation 130 has cracked around or near the buckstay 150, the surface of the foundation may be unable to support the compression device 155. The anchoring beam 405 can anchor into an intact portion of the foundation 130 below the cracked portion to provide force to counteract the thermal expansion of the oven 100. The anchoring beam 405 can have any length sufficient to anchor into an intact region of the foundation 130.

Figure 5A:
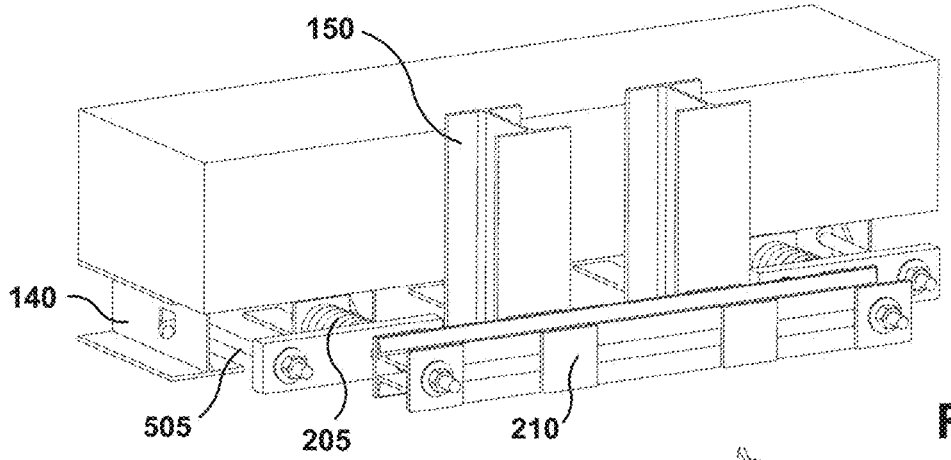
FIGS. 5A-5C illustrate another example compression device.
Figure 5B:
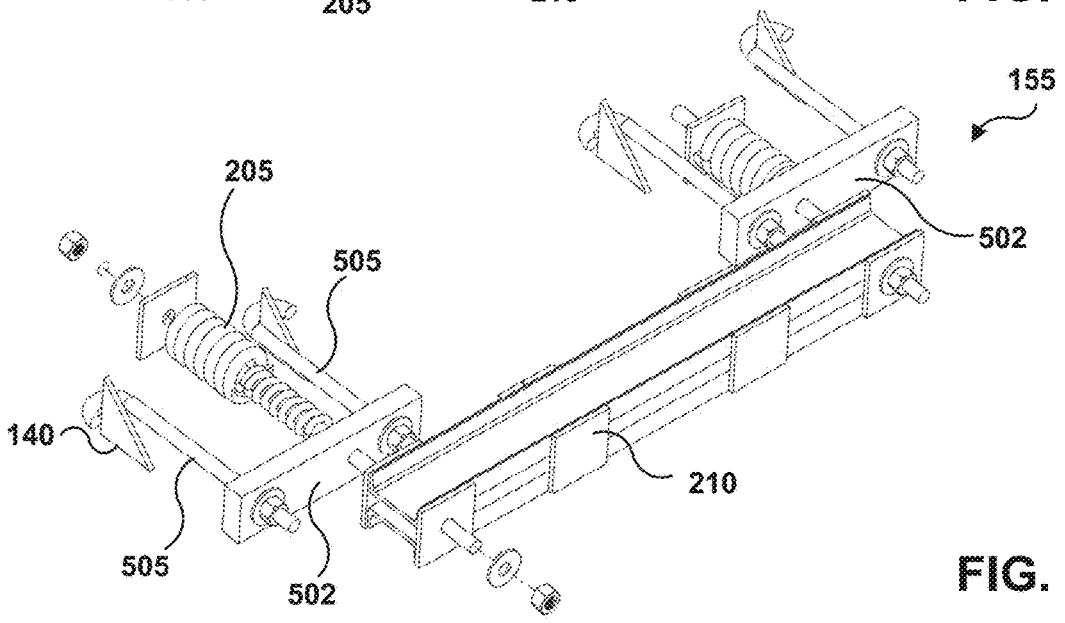
Figure 5C:
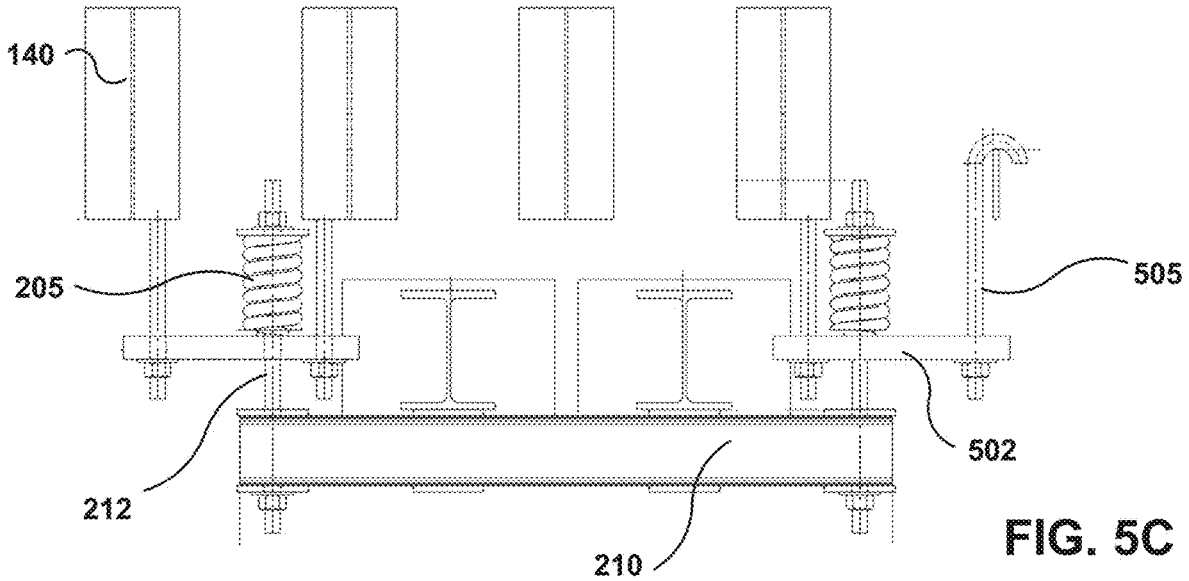

FIGS. 5A-5C illustrate yet another example compression device 155. FIG. 5A shows a perspective view of a portion of the oven, FIG. 5B shows an expanded view of the example compression device 155, and FIG. 5C is a top view of the compression device 155 in the oven. The compression device 155 shown in FIGS. 5A-5C includes a restraining device 210 on the outside of one or more buckstays 150. Each end of the restraining device 210 is coupled to a plate 502 by the connecting rod 212. The spring 205, also coupled to the connecting rod 212, applies force against the plate 502 to compress the restraining device 210 against the one or more buckstays 150. One or more springs can be coupled to the connecting rod 212 at either end of the restraining device 210. As shown in FIGS. 5A-5C, the example compression device 155 also includes a J-hook 505 that can hook into a beam 140. For example, if the beams 140 are I-beams, the J-hook 505 can pass through a hole in the web of a beam 140. The J-hook 505 can be coupled to the plate 502. In some embodiments, a J-hook can be coupled to the plate 502 on either side of both springs 205. Alternatively, the compression device 155 can include fewer or additional J-hooks 505. For example, the compression device 155 can include two hooks 505, one positioned at either end of the restraining device 210.

Figure 6A:
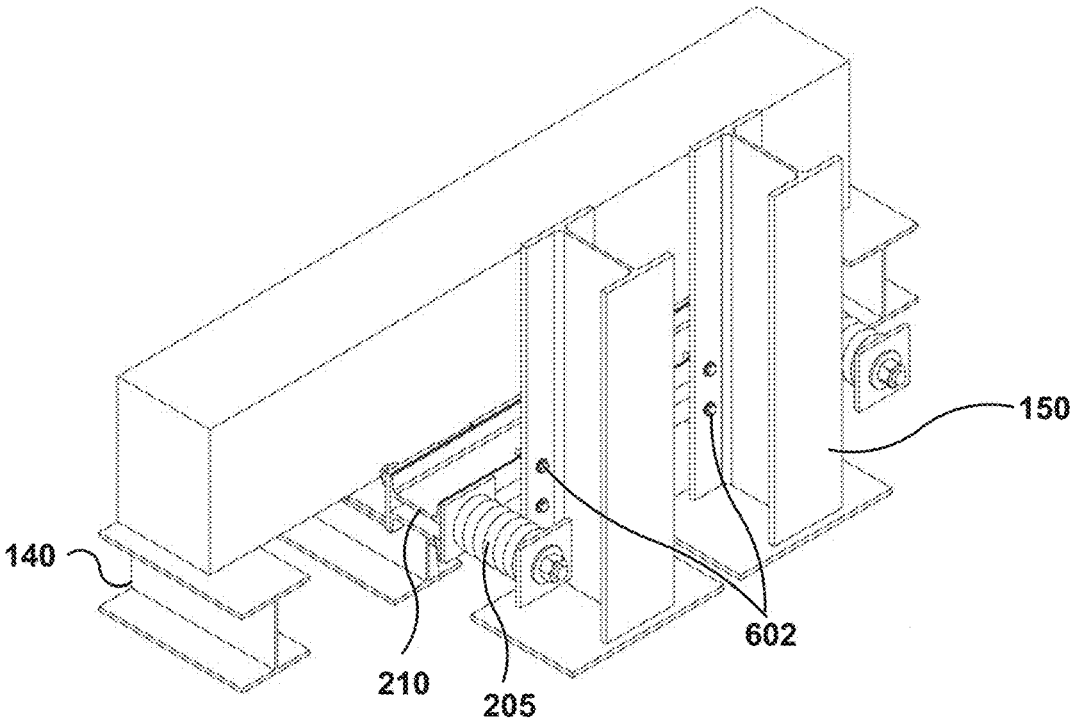
FIGS. 6A-6E illustrate another example compression device.
Figure 6B:
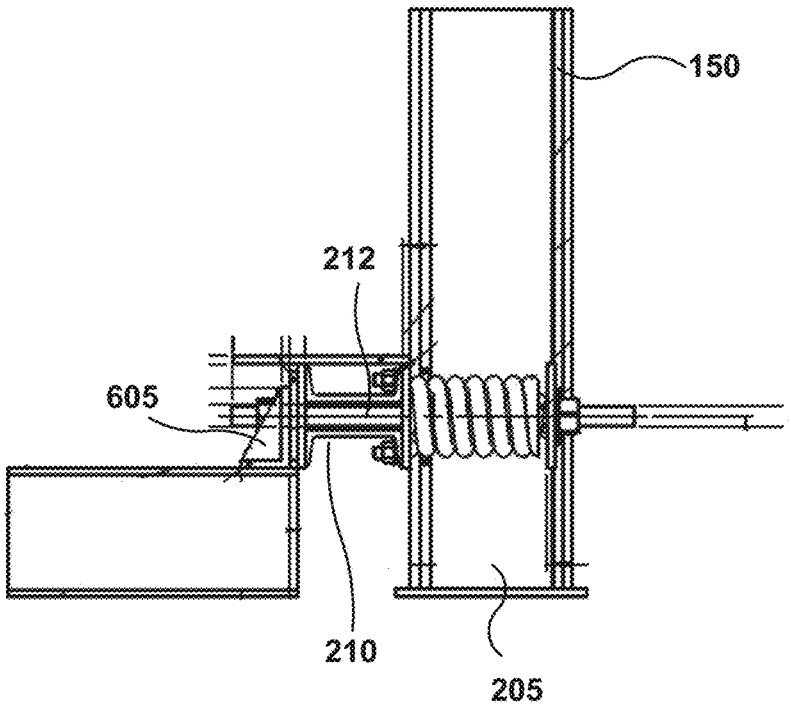
Figure 6C:
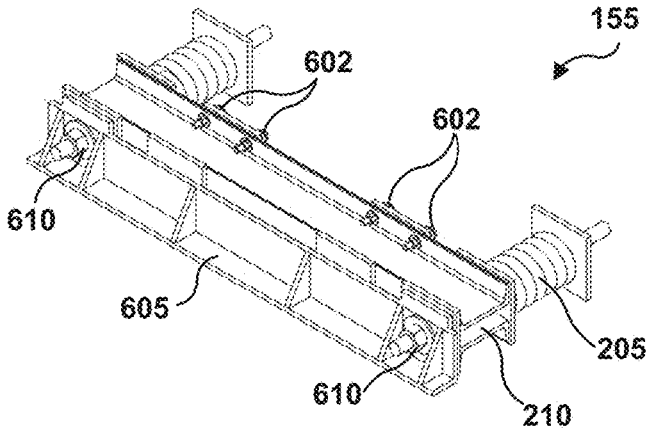
Figure 6D:
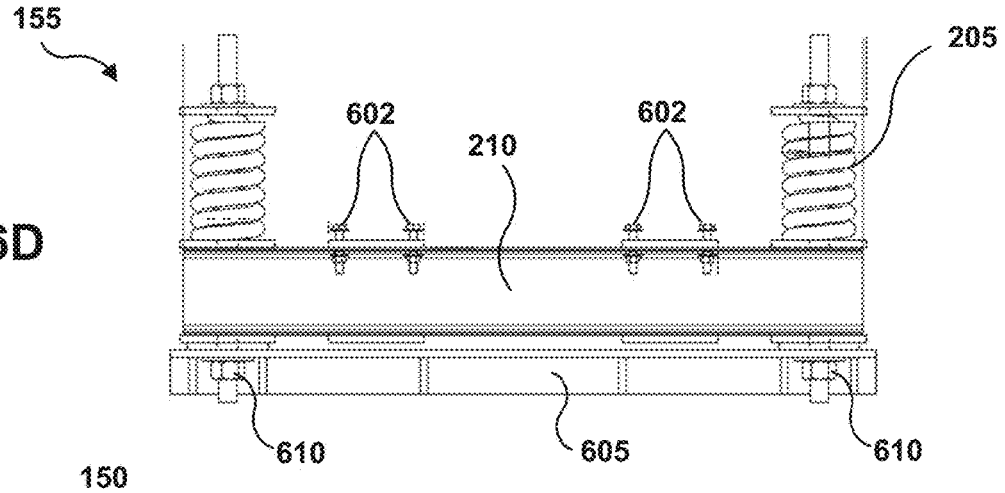
Figure 6E:
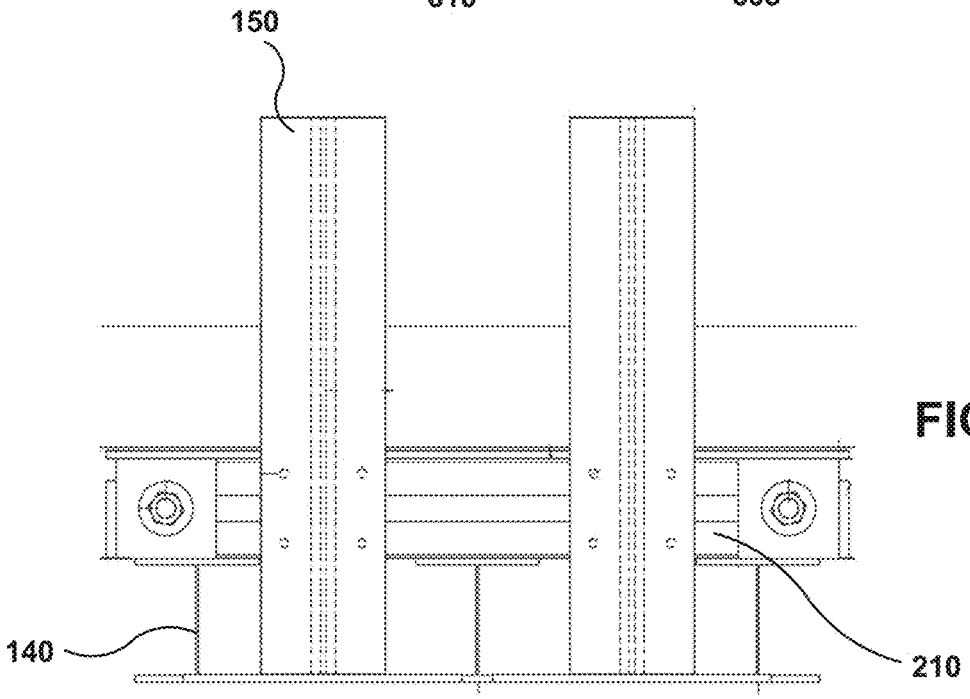

FIGS. 6A-6E illustrate still another example compression device 155, in which the restraining device 210 is positioned behind one or more buckstays 150. FIG. 6A is a perspective view of a portion of the oven and FIG. 6B is a side view. FIG. 6C is a perspective view of the example compression device 155, FIG. 6D is a top view, and FIG. 6E is a front view of the compression device 155 with a portion of the oven. The restraining device 210 in the example of FIGS. 6A-6E can be coupled to the back of the one or more buckstays 150 by welds, nut bolting, and/or other connectors. For example, FIGS. 6A-6E show bolts 602 drilled into the restraining device 210 and a flange of two adjacent buckstays 150 to connect the restraining device 210 to the buckstays 150. The restraining device 210 can be anchored to one or more beams 140 by, for example, a bracket 605 that is attached to the restraining device 210 and a flange of the beams 140. Each end of the restraining device 210 can be coupled to the bracket 605 by a connecting rod 212 and a bolt 610 that applies force between the restraining device 210 and the bracket 605. FIGS. 6D-6E illustrate that both ends of the restraining device 210 can be coupled to the same bracket 605. However, in other embodiments, the ends of the restraining device 210 can each be coupled to a separate bracket 605. Furthermore, there may be additional connection points between the restraining device 210 and the bracket 605 in other embodiments. The spring 205 can be positioned in front of the restraining device 210 and coupled to the bracket 605 by the connecting rod 212, such that the spring applies force to resist expansion of the oven body by compressing the buckstays 150 against the oven body. Instead of or in addition to being coupled to the bracket 605, the restraining device 210 can pass through the beams 140.

Figure 7A:
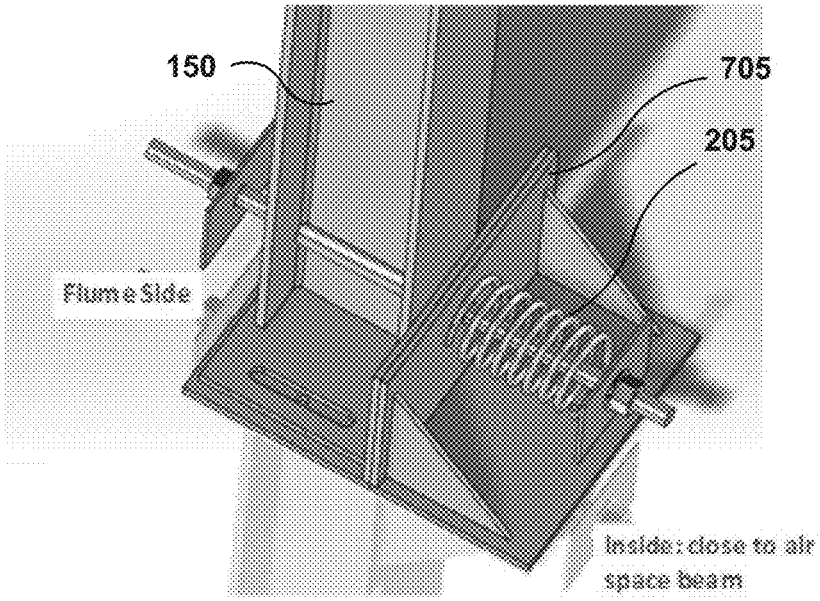
FIGS. 7A-7C illustrate another example compression device.
Figure 7B:
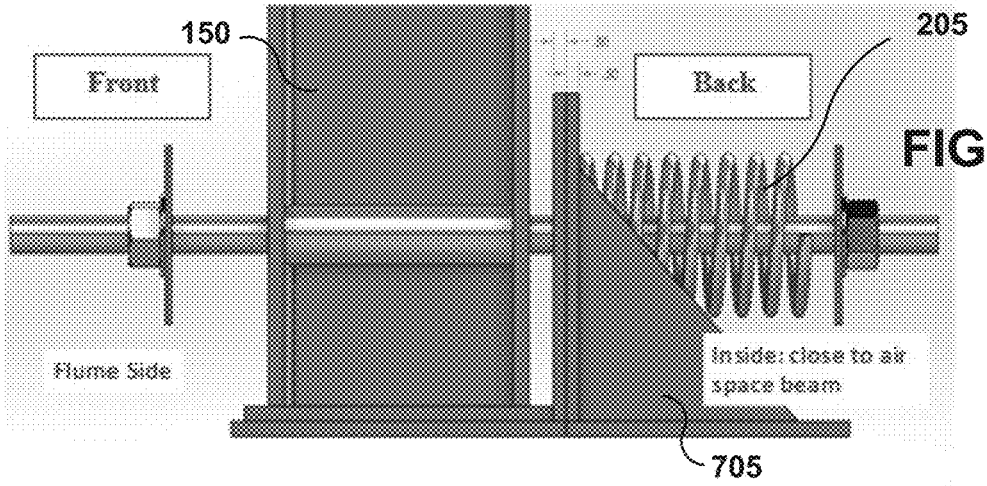
Figure 7C:
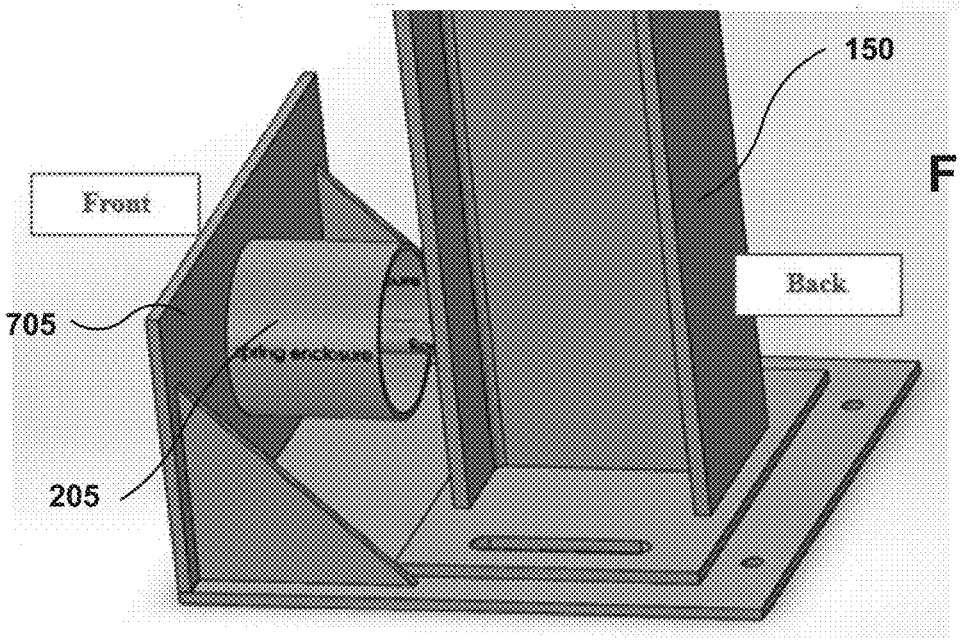

A smaller example compression device 155 is shown in FIGS. 7A-7C. In FIGS. 7A-7C, a bracket 705 is used as the restraining device 210. The bracket 705 can provide counterforce against a single buckstay 150. In some embodiments, as shown in FIGS. 7A-7B, the bracket 705 is on a back side of the buckstay 150 (i.e., toward the oven), In other embodiments, as shown for example in FIG. 7C, the bracket 705 is on a front side of the buckstay 150. Alternatively, the compression device 155 can include a bracket and spring positioned on both the front and back side of the buckstay 150. The bracket 705 can be anchored to the beams 140, the foundation 130, or another component of the oven 100. For example, the bracket 705 can be attached to a top flange of a beam 140 by bolts or other connectors, or can be drilled into the foundation. The spring 205 is compressible between the bracket 705 and the buckstay 150 to compress the buckstay 150 against the oven 100. The connecting rod 212 passes through the buckstay 150 (e.g., through holes in the flanges of the buckstay 150) to couple the bracket 705 and spring 205 to the buckstay 150.

Figure 8A:
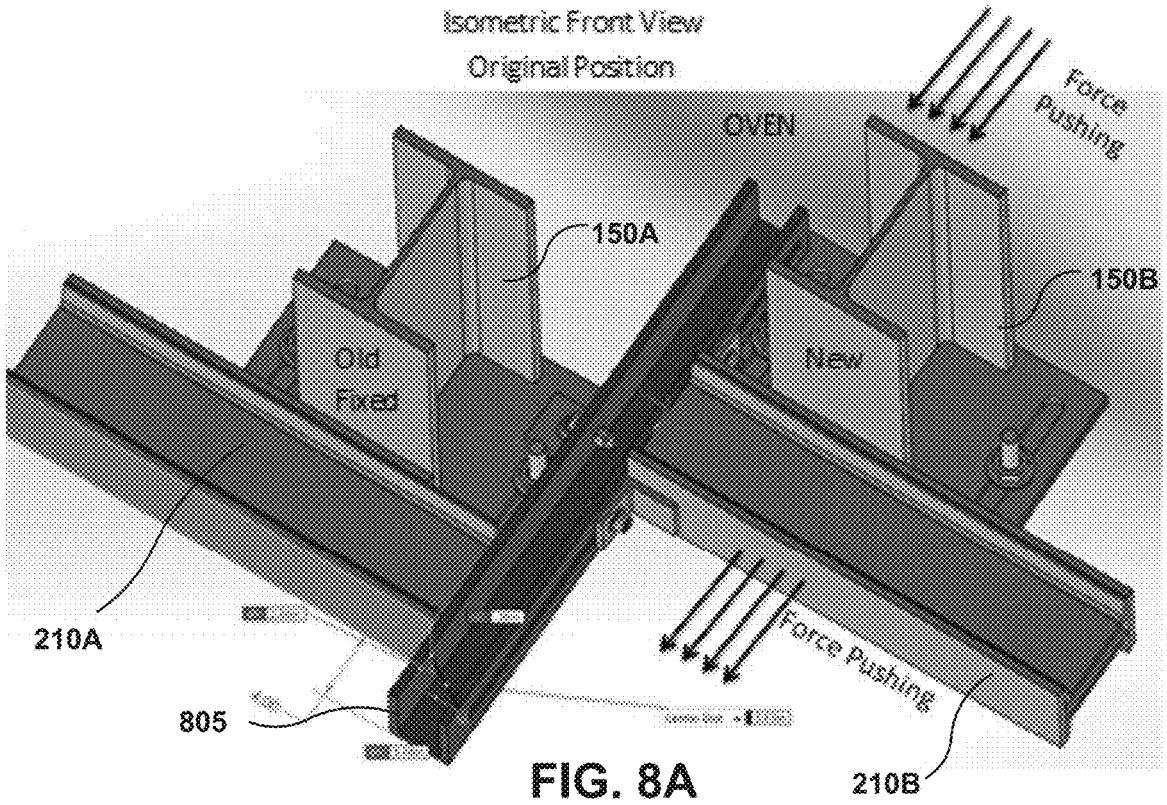
FIGS. 8A-8B illustrate an example compression device that can be used while a coke oven or its components are being repaired.
Figure 8B:
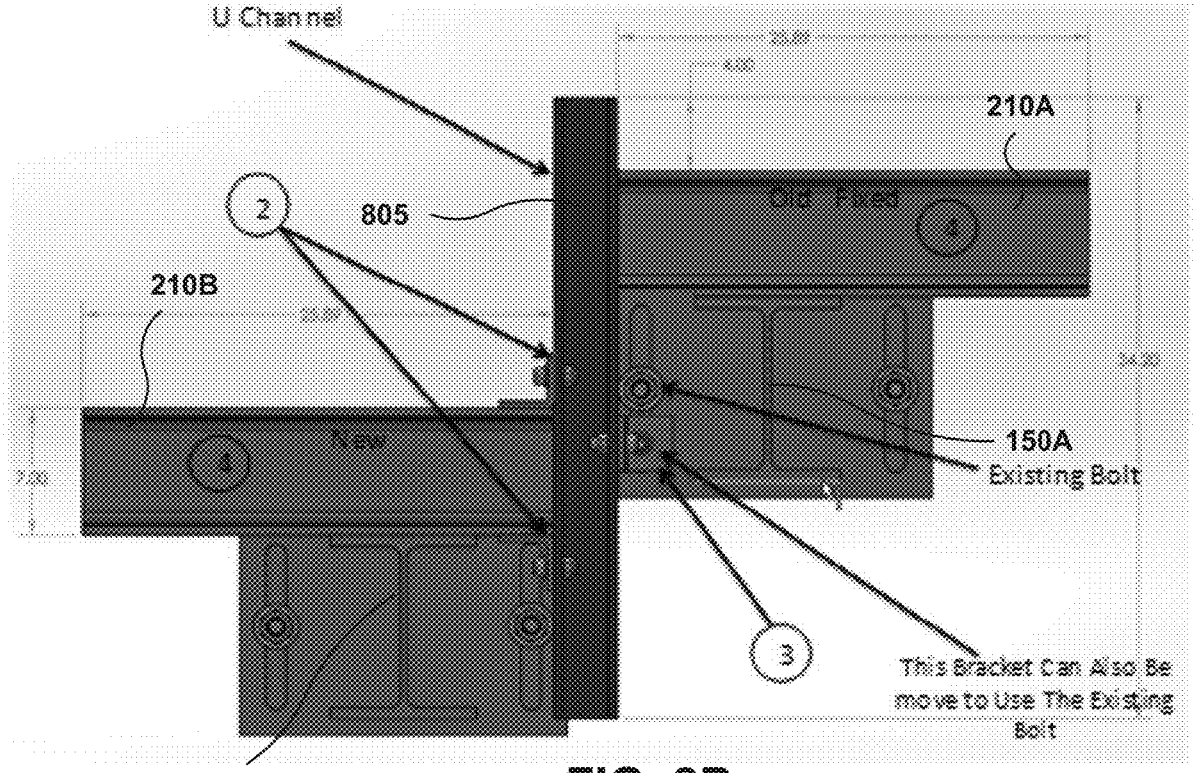

FIGS. 8A-8B illustrate an example compression device 155 that can be used while the restraining device, oven 100, buckstays 150, or other components are being repaired. The compression device 155 shown in FIGS. 8A-8B includes a first restraining device 210A positioned behind a first (old) buckstay 150A, a second restraining device 210B positioned behind a second (new) buckstay 1503, and a U-channel 805 coupling the first restraining device 210A to the second restraining device 2103. In the example of FIGS. 8A-8B, the old oven is hot (and therefore expanded) while the new oven is colder (and therefore not expanded). Accordingly, the front faces of the first buckstay 150A and second buckstay 150E are not aligned. However, depending on the temperature of the respective ovens, the first and second buckstays 150A, 150B may have different relative positions than shown. One or more springs can be used to compress the buckstays 150 against the restraining devices 210, using for example any of the example spring positions shown in FIGS. 2A-7C.

Figure 9:
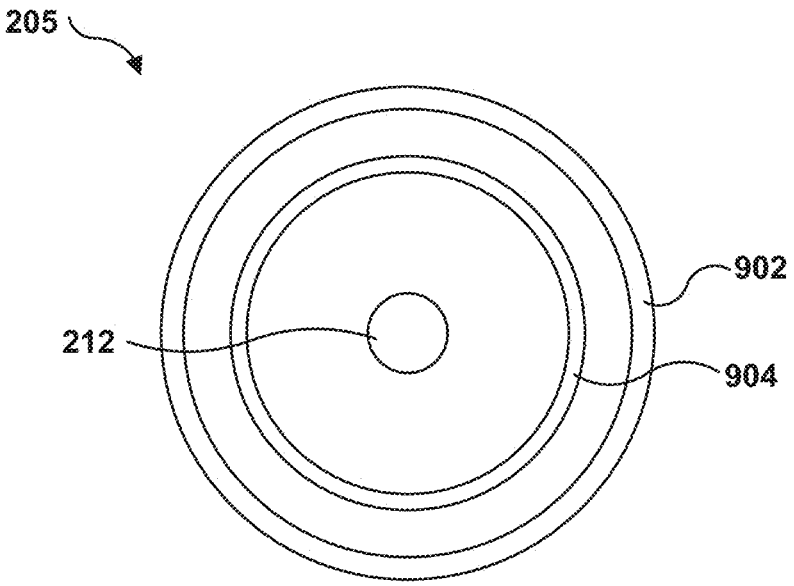
FIG. 9 shows an example spring including two concentric springs.

In various embodiments, any of the springs described with respect to FIGS. 2A-8B (such as the springs 205 or 215) can each comprise two or more concentric springs. FIG. 9 shows an example spring 205 that includes two concentric springs, in which a smaller-diameter spring 904 is positioned inside of a larger-diameter spring 902, both of which are concentric to the connecting rod 212. The larger spring 902 can have a different spring constant than the smaller spring 904, or the springs 902, 904 can have the same spring constant. The spring 205 can also include additional springs concentric to the springs 902, 904.

Any of a variety of other configuration of the spring-loaded compression device 155 may be used instead of those shown in FIGS. 2A-8B. The restraining device 210 and springs 205 can have different positions relative to the buckstays 150, or additional or fewer restraining devices or springs can be used with those shown in the example figures. The compression device 155 can anchor to any of a variety of structures on the oven 100. For example, the compression device 155 can anchor to one or more beams 140 by coupling to an anchor that passes through a hole in the beam, coupling to a support that is placed across two or more beams 140, coupling to a support or angle attached to a top flat part of one or more beams 140, or otherwise attaching or coupling to a beam 140. The compression device 155 can additionally or alternatively couple to an anchor that is anchored to the foundation 130, castable slab 125, or to a compression device 155 on an opposite side of the oven 100.

From the foregoing it will be appreciated that, although specific embodiments of the technology have been described herein for purposes of illustration, various modifications may be made without deviating from the spirit and scope of the technology. Further, certain aspects of the new technology described in the context of particular embodiments may be combined or eliminated in other embodiments. Moreover, while advantages associated with certain embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein. Thus, the disclosure is not limited except as by the appended claims.

We claim:

1. A coke oven, comprising:

an oven body;

a foundation;

a plurality of beams separating the oven body from the foundation;

a first buckstay and a second buckstay spaced apart from the first buckstay, each of the first buckstay and the second buckstay extending in a vertical direction and being positioned to apply force toward the oven body, the first buckstay comprising a first side and a second side laterally opposite the first side, the second buckstay comprising a first side adjacent the second side of the first buckstay and a second side laterally opposite the first side of the second buckstay; and a spring-loaded compression device including:

a restraining device comprising a rigid structure having a first end portion and a second end portion laterally opposite the first end portion, the rigid structure extending laterally across the first buckstay and the second buckstay; and a first spring coupled to the first end portion of the restraining device and a second spring coupled to the second end portion of the restraining device, the first spring and the second spring being configured to apply force against the restraining device to compress the first buckstay and the second buckstay against the oven body, wherein the restraining device is inward of the first spring and the second spring.

2. The coke oven of claim 1, wherein the restraining device is between (i) the first buckstay and the second buckstay and (ii) the oven body.

3. The coke oven of claim 1, wherein the oven body is inward of the restraining device, and the restraining device is inward of the first buckstay.

4. The coke oven of claim 1, further comprising a first connecting rod coupling the first spring to the restraining device and a second connecting rod coupling the second spring to the restraining device.

5. The coke oven of claim 1, further comprising a connecting rod extending through the first end portion of the restraining device and the first spring.

6. The coke oven of claim 1, further comprising an anchor positioned inward of the first spring and fixedly attached to the foundation, and a connecting rod extending through the first end portion of the restraining device, the first spring, and the anchor.

7. The coke oven of claim 1, wherein the first buckstay extends vertically upward from the restraining device, the coke oven further comprising an anchor fixedly attached to the foundation and extending downward from the restraining device.

8. The coke oven of claim 1, further comprising a plate extending in a lateral direction and positioned between the first end portion of the restraining device and the first spring.

9. The coke oven of claim 8, wherein the plate is a first plate, the coke oven further comprising a second plate extending in the lateral direction and positioned between the second end portion of the restraining device and the second spring.

10. A bridle assembly for a coke oven, the bridle assembly including a first buckstay and a second buckstay each configured to constrain thermal expansion of the coke oven, the bridle assembly comprising:

a restraining device comprising a rigid structure having a first end portion and a second end portion laterally opposite the first end portion, the rigid structure extending laterally across the first buckstay and the second buckstay; and a first spring coupled to the first end portion of the restraining device and a second spring coupled to the second end portion of the restraining device, the first spring and the second spring applying force against the restraining device to compress the first buckstay and the second buckstay against the oven body, wherein the restraining device is inward of the first spring and the second spring.

11. The bridle assembly of claim 10, further comprising a first connecting rod coupling the first spring to the restraining device and a second connecting rod coupling the second spring to the restraining device.

12. The bridle assembly of claim 10, further comprising a connecting rod extending through the first end portion of the restraining device and the first spring.

13. The bridle assembly of claim 10, further comprising an anchor positioned inward of the first spring, and a connecting rod extending through the first end portion of the restraining device, the first spring, and the anchor.

* * * * *